US009421754B2

(12) United States Patent
Izume

(10) Patent No.: US 9,421,754 B2
(45) Date of Patent: Aug. 23, 2016

(54) PRINTING PLATE UNIT, PRINTING PLATE ATTACHMENT DEVICE AND PRINTER

(76) Inventor: Masayuki Izume, Kyoto (JP)

( * ) Notice: Subject to any disclaimer, the term of this patent is extended or adjusted under 35 U.S.C. 154(b) by 0 days.

(21) Appl. No.: 13/700,509

(22) PCT Filed: May 14, 2012

(86) PCT No.: PCT/JP2012/062270

§ 371 (c)(1),
(2), (4) Date: Nov. 28, 2012

(87) PCT Pub. No.: WO2013/171818

PCT Pub. Date: Nov. 21, 2013

(65) Prior Publication Data

US 2015/0083007 A1 Mar. 26, 2015

(51) Int. Cl.

| | |
|---|---|
| ***B41F 27/12*** | (2006.01) |
| ***B41F 13/20*** | (2006.01) |
| ***B41F 27/06*** | (2006.01) |

(52) U.S. Cl.

CPC ..... *B41F 13/20* (2013.01); *B41F 27/06* (2013.01); *B41F 27/12* (2013.01); *B41F 27/1231* (2013.01); *B41F 27/1237* (2013.01)

(58) Field of Classification Search

CPC ..... B41F 27/10; B41F 27/105; B41F 27/12; B41F 27/1218; B41F 27/1225; B41F 27/1231; B41F 27/1237; B41F 27/1293; B41F 27/14; B41F 30/00; B41F 30/02; B41P 2227/20; B41P 2227/21

USPC ..... 101/409, 415.1

See application file for complete search history.

(56) References Cited

U.S. PATENT DOCUMENTS

| | | | | |
|---|---|---|---|---|
| 2,820,409 | A * | 1/1958 | Johnson | 101/415.1 |
| 3,353,481 | A * | 11/1967 | Antonucci | 101/93.34 |
| 6,578,484 | B2 * | 6/2003 | Fusco | 101/415.1 |
| 2008/0216691 | A1 * | 9/2008 | Stephens | 101/378 |

FOREIGN PATENT DOCUMENTS

| | | | |
|---|---|---|---|
| JP | 2006247872 | A * | 9/2006 |
| JP | 2009-285861 | A | 12/2009 |

* cited by examiner

*Primary Examiner* — Justin Olamit

(74) *Attorney, Agent, or Firm* — Locke Lord LLP; James E. Armstrong, IV; Brian S. Matross

(57) ABSTRACT

To attach a printing plate to a printer readily and accurately, and avoid necessity of a large space for the storage of the printing plate. A printing plate unit 1 includes a printing plate 3 in which a plate section 9 is provided on a part of a front surface of a sheet 8 made of an elastic material and engaging protrusions 10 that protrude toward a back surface and extend in a width direction are provided at both longitudinal ends, and a printing plate coupling member 4 that is detachable from the printing plate 3 and couples both the engaging protrusions 10 of the cylindrical printing plate 3 to each other to keep the cylindrical shape of the printing plate 3.

19 Claims, 10 Drawing Sheets

PRINTING PLATE UNIT, PRINTING PLATE ATTACHMENT DEVICE AND PRINTER

TECHNICAL FIELD

The present invention relates to a printing plate unit, a printing plate attachment device, and a printer.

BACKGROUND ART

A printer in which a printing plate is attached to the outer periphery of a plate cylinder fixed to a plate driving shaft has been known.

In such printer, a sheet-like printing plate may be attached by being wound around the plate cylinder fixed to the plate driving shaft. In this case, the operation of attaching the printing plate in the printer is cumbersome, making accurate attachment of the printing plate to the plate cylinder difficult.

To avoid this situation, after winding the sheet-like printing plate around the plate cylinder removed from the plate driving shaft, the plate cylinder may be fixed to the plate driving shaft. In this case, since the plate cylinder is substantially heavy, it is difficult to detach/attach the plate cylinder from/to the plate driving shaft.

Inventor proposes a printing plate that can be attached to the printer readily and accurately by providing a plate section on a part of the outer peripheral surface of a cylindrical plate body made of an elastic material, and forming an engagement part on the inner periphery of the plate body so as to protrude inward and extend in the axial direction (refer to Patent document 1).

The printing plate is attached to a printing plate attachment device of the printer for use. For example, the printing plate attachment device includes a plate cylinder part fixedly provided at the plate driving shaft, and the printing plate is fitted into the plate cylinder part from one end. By providing a circumferential positioning groove, into which the engagement part of the printing plate is fitted from the one end, and an axial positioning stopper that comes into contact with the end of the printing plate on the outer periphery of the plate cylinder part, the printing plate can be attached to a predetermined position of the plate cylinder part accurately and readily. Further, the printing plate can be readily detached from the one end of the plate cylinder part.

Patent Document 1: Japanese Unexamined Patent Publication No. 2009-285861

SUMMARY OF THE INVENTION

Problems to be Solved by the Invention

The printing plate can be recycled, and the used printing plate is detached from the plate cylinder part and stored. However, since the above-mentioned printing plate is previously shaped like a cylinder, a relatively large space for storage is required.

An object of the present invention is to solve the above-mentioned problem and to provide a printing plate unit that enables the printing plate to be attached to the printer readily and accurately, and does not require a large storage space.

Another object of the present invention is to provide a printing plate attachment device and a printer that enable easy and accurate attachment of the printing plate.

Means for Solving the Problems

A printing plate unit according to the present invention includes a printing plate in which a plate section is provided on a part of a front surface of a sheet made of an elastic material, and engaging protrusions that protrude toward a back surface or a front surface and extend in a width direction are provided at both longitudinal ends; and a printing plate coupling member that is detachable from the printing plate, and engages with both the engaging protrusions of the printing plate which is formed to be cylindrical to couple both longitudinal ends of the cylindrical printing plate.

In this specification, a surface oriented to the radially outer side when the sheet constituting the printing plate is cylindrically formed is defined as "front surface" of the sheet, and a surface oriented to the radially inner side is defined as "back surface". The circumferential direction at the time when the sheet is cylindrically formed is defined as "longitudinal direction" of the sheet, and the axial direction is defined as the "width direction" of the sheet.

By coupling both the ends of the cylindrical printing plate to each other with the printing plate coupling member, the printing plate is kept cylindrical. Since both the ends of the printing plate is fixed to the printing plate coupling member in the state where the engaging protrusions are engaged with the printing plate coupling member, even when the printing plate is pulled, the printing plate is not detached from the printing plate coupling member.

Given that an angle that each engaging protrusion forms with the adjacent part of the sheet is a protrusion angle of the engaging protrusions, in consideration of the strength of engagement between the printing plate and the printing plate coupling member, the protrusion angle is preferably smaller than 90 degrees. The protrusion angle of the engaging protrusions is more preferably, in the range of 35 to 55 degrees and most preferably, 45 degrees.

For example, the engaging protrusions each are formed integrally with the sheet by bending each end of the flat plate-like sheet toward the back surface and the front surface.

The printing plate constituting the printing plate unit according to the present invention is attached to a plate attaching device of a printer for use. For example, the plate attaching device includes the printing plate coupling member constituting the printing plate unit and a plate cylinder part fixedly provided at a plate driving shaft of the printer. The printing plate unit is attached to the plate cylinder part from one end, and is detached from the same one end. By attaching the printing plate unit to the plate cylinder part and then, biasing the printing plate coupling member outward in the radial direction, a part of the printing plate is brought into close contact with the outer peripheral surface of the plate cylinder part. Attachment/detachment of the printing plate unit to/from the plate cylinder part is performed in the state where the printing plate coupling member is not biased outward in the radial direction. At this time, since the printing plate constituting the printing plate unit is kept cylindrical by the printing plate coupling member, attachment/detachment of the printing plate unit to/from the plate cylinder part can be readily performed. Further, the printing plate coupling member can function as a guide for attachment and detachment.

While the printing plate unit is not used, the printing plate coupling member can be detached from the printing plate, and the printing plate in the form of a flat plate can be stored. For this reason, a large space for storage of the printing plate is not required.

Both the engaging protrusions of the printing plate may protrude in the same direction or in the opposite directions.

For example, both the engaging protrusions protrude toward the back surface of the sheet.

For example, the printing plate coupling member includes an inner clamping member and an outer clamping member that clamps both the longitudinal ends of the cylindrical printing plate from both radially inner and outer sides.

In the case where both the engaging protrusions of the printing plate protrude toward the back surface, both the engaging protrusions engage with the inner clamping member. In the case where both the engaging protrusions of the printing plate protrude toward the front surface, both the engaging protrusions engage with the outer clamping member. In the case where both the engaging protrusions of the printing plate protrude in the opposite directions, the engaging protrusion protruding toward the back surface engages with the inner clamping member, and the engaging protrusion protruding toward the front surface engages with the outer clamping member.

In this case, by clamping both the ends of the printing plate with both the clamping members in the state where the engaging protrusions at the ends of the printing plate engage with the inner clamping member or the outer clamping member, both the ends of the printing plate can be reliably fixed to the printing plate coupling member.

The clamping member that engages with the engaging protrusions of the printing plate is provided with an engagement part.

The engagement part engages with, for example, a part between the engaging protrusion and the adjacent part of the sheet. Thus, the engaging protrusions are reliably engaged with the clamping member.

The engagement part is, for example, formed by forming a groove extending in the axial direction on a surface of the inner clamping member, which is oriented to the radially outer side, or a surface of the outer clamping member, which is oriented to the radially inner side. In this case, a part between the groove and the surface of the clamping member, in which the groove is formed, constitutes the engagement part.

Preferably, the engagement part is in close contact with both the engaging protrusion and the back surface of the sheet. As a result, both the ends of the printing plate are fixed between both the inner and outer clamping members more reliably.

For example, the inner clamping member includes a clamping part that clamps the printing plate and a guided part that extends inward from the clamping part in the radial direction of the cylindrical printing plate.

In this case, by attaching the printing plate unit to the plate cylinder part from one end using the guided part of the inner clamping member as a guide and then, biasing the guided part of the inner clamping member outward in the radial direction, the printing plate can be fixedly brought into close contact with the outer peripheral surface of the plate cylinder part.

For example, threaded hole-forming parts each having a predetermined thickness in the radial direction of the cylindrical printing plate are formed at a plurality of places of the inner clamping member, a threaded hole having a female screw penetrating each threaded hole-forming part in the radial direction is formed in each threaded hole-forming part, screw-insertion through holes that correspond to the threaded holes and penetrate the outer clamping member in the radial direction are formed at a plurality of places of the outer clamping member, a plurality of clamping screw members penetrate the screw-insertion through holes from the radially outer side and are screwed into the threaded holes, in the state where both the clamping members are fixed with the clamping screw members, a retaining stopper is provided at a part of the clamping screw member protruding from the threaded hole inward in the radial direction, the part being away from the threaded hole-forming part inward in the radial direction, and permanent magnets are provided at both the clamping members so as to repel each other.

When the clamping screw members are released, the outer clamping member is separated from the inner clamping member by the magnetic repelling force of the permanent magnets. For this reason, there is no need to separate the outer clamping member from the inner clamping member by hand. By engaging the engaging protrusion at each end of the printing plate with either of the clamping members in the state where both the clamping members are separated from each other as described above and fastening the screw members, the engaging protrusions at both the ends of the printing plate are clamped by both the clamping members. Then, by releasing the screw members and separating the outer clamping member from the inner clamping member, the printing plate is detached from the clamping member. When the screw members are released until the retaining stoppers provided at the screw members reach the ends of the threaded holes, the screw members can not be released any more, both the inner and outer clamping members are attached to the screw members. For this reason, even in the state where the printing plate is detached from both the clamping members, both the clamping members are not separated from the screw members, which is easy to handle.

For example, the inner clamping member includes a clamping part that clamps the printing plate and a guided part that extends inward from the clamping part in the radial direction of the cylindrical printing plate, a plurality of perforated parts that penetrate the guided part in the circumferential direction of the cylindrical printing plate, and parts on the outer side of the perforated parts in the radial direction of the cylindrical printing plate constitutes the threaded hole-forming parts.

In this case, the front end of the clamping screw member is located in the perforated part of the guided part and therefore, does not become an obstacle.

A printing plate attachment device according to the present invention is a device for attaching a printing plate, in which a plate section is provided on a part of a front surface of a sheet made of an elastic material, and engaging protrusions that protrude toward a back surface or a front surface and extend in a width direction are provided at both longitudinal ends, to a plate driving shaft of a printer, the device including a printing plate coupling member that is detachable from the printing plate and engages with both the engaging protrusions of the printing plate which is formed to be cylindrical to couple both longitudinal ends of the cylindrical printing plate to each other; and a cylindrical plate cylinder part that is fixedly provided at the plate driving shaft and has an outer periphery to which the cylindrical printing plate is attached from the side of a front end of the plate driving shaft, wherein the plate cylinder part includes a printing plate coupling member storing groove that stores the printing plate coupling member to which the cylindrical printing plate is coupled from the side of the front end of the plate driving shaft, an axial positioning stopper part that contacts a bottom end of the plate driving shaft of the printing plate coupling member, a printing plate coupling member guiding part that guides the printing plate coupling member to move in a predetermined range of the plate cylinder part in the radial direction, and a printing plate coupling member biasing device that biases the printing plate coupling member outward in the radial direction of the plate cylinder part.

Both the ends of the printing plate are coupled to each other with the printing plate coupling member and the printing plate is kept cylindrical to constitute the printing plate unit according to the present invention.

When the printing plate is cylindrically formed in the printing plate unit, the inner diameter of the printing plate unit is slightly larger than the outer diameter of the plate cylinder part.

The printing plate in the form of the printing plate unit is attached to the printing plate attachment device. When the printing plate unit is attached to the printing plate attachment device, the printing plate coupling member biasing device is brought so as not to bias the printing plate coupling member outward in the radial direction. In this state, the printing plate unit is attached to the plate cylinder part from one end such that the printing plate coupling member is fitted into the printing plate coupling member storing groove, thereby bringing the bottom end of the printing plate coupling member into contact with the axial positioning stopper part. Thereby, the printing plate is attached to a predetermined position of the plate cylinder part accurately and readily. Since the inner diameter of the cylindrical printing plate is slightly larger than the outer diameter of the plate cylinder part, and the printing plate coupling member biasing device does not bias the printing plate coupling member outward in the radial direction when the printing plate is attached, a gap is generated between the outer peripheral surface of the plate cylinder and the printing plate and therefore, the printing plate can be readily attached to the plate cylinder part. Upon completion of attachment of the printing plate, the printing plate coupling member biasing device biases the printing plate coupling member outward in the radial direction, thereby bringing the printing plate into close contact with the outer peripheral surface of the plate cylinder part. In this manner, the printing plate coupling member of the printing plate unit is attached to the printing plate coupling member storing groove of the plate cylinder part, the bottom end of the printing plate coupling member contacts the axial positioning stopper part, and the printing plate is brought into close contact with the outer peripheral surface of the plate cylinder part by the printing plate coupling member biasing device. As a result, the printing plate is positioned in the circumferential direction and the axial direction, and during use, the printing plate is not displaced with respect to the plate cylinder part.

When the printing plate is detached from the printing plate attachment device, the printing plate coupling member biasing device is set so as not to bias the printing plate coupling member outward in the radial direction. Thereby, a gap is generated between the outer peripheral surface of the plate cylinder part and the printing plate and therefore, the printing plate unit can be moved to the axial direction to be readily detached from one end of the plate cylinder part.

It is preferred that a difference between the inner diameter of the cylindrical printing plate and the outer diameter of the outer peripheral surface of the plate cylinder part is made as small as possible within the extent that attachment/detachment of the printing plate unit to/from the plate cylinder part can be readily performed.

Both the engaging protrusions of the printing plate may protrude in the same direction or in the opposite directions. Preferably, both the engaging protrusions protrude toward the back surface of the sheet.

For example, the printing plate coupling member storing groove is provided in a groove formation surface provided on the outer periphery of the plate cylinder part, the axial positioning stopper part is provided at a bottom end of the plate driving shaft of the printing plate storing groove, the printing plate coupling member guiding part is provided in the printing plate coupling member storing groove, and at least a part of the printing plate coupling member biasing device is provided in a biasing device storing recess formed on the bottom of the printing plate coupling member storing groove.

For example, the groove formation surface is formed by removing a part of the outer cylindrical surface of the plate cylinder part. The groove formation surface may be a curved surface and however, is preferably a flat surface.

Relationship between the plate cylinder part and the printing plate unit in size is determined such that the printing plate coupling member does not protrude outward in the radial direction from the virtual cylindrical surface including the outer peripheral surface of the plate cylinder part, in the state where the printing plate unit is attached to the plate cylinder part, and the printing plate is brought into close contact with the outer peripheral surface of the plate cylinder part by the printing plate coupling member biasing device. By removing a part of the outer cylindrical surface of the outer periphery of the plate cylinder part to form the groove formation surface, such relationship in size can be achieved.

For example, the printing plate coupling member includes an inner clamping member and an outer clamping member that clamp both longitudinal ends of the cylindrical printing plate from both radially inner and outer sides.

In this case, since both the ends of the printing plate are clamped by both the clamping members in the state where the engaging protrusion at each end of the printing plate is engaged with the inner clamping member or the outer clamping member, both the ends of the printing plate are reliably fixed to the printing plate coupling member.

For example, the inner clamping member is a guided member guided to the printing plate coupling member guiding part when or after the printing plate coupling member is stored in the printing plate coupling member storing groove, and is biased outward in the radial direction of the plate cylinder part by the printing plate coupling member biasing device.

In this case, by guiding the inner clamping member by use of the printing plate coupling member guiding part of the plate cylinder part, the printing plate unit can be readily attached to the plate cylinder part from one end, and the printing plate coupling member can be smoothly moved in the radial direction. Further, by attaching the printing plate unit to the plate cylinder part and then, biasing the inner clamping member outward in the radial direction with the printing plate coupling member biasing device, the printing plate can be reliably fixed in close contact with the outer peripheral surface of the plate cylinder part.

For example, the inner clamping member includes a clamping part that clamps the printing plate and a guided part that extends inward from the clamping part in the radial direction of the cylindrical printing plate, and the guided part is guided by the printing plate coupling member guiding part and biased by the printing plate coupling member biasing device.

In this case, by guiding the guided part of the inner clamping member by use of the printing plate coupling member guiding part of the plate cylinder part, the printing plate unit can be readily attached to the plate cylinder part from one end, and the printing plate coupling member can be smoothly moved in the radial direction. Further, by attaching the printing plate unit to the plate cylinder part and then, biasing the guided part of the inner clamping member outward in the radial direction with the printing plate coupling member biasing device, the printing plate can be reliably fixed in close contact with the outer peripheral surface of the plate cylinder part.

For example, opposed guiding protrusions that extend in the axial direction of the plate cylinder part to constitute the printing plate coupling member guiding part are provided in side walls of the printing plate coupling member storing groove, which are opposed to each other in the circumferential direction of the plate cylinder part, an intermediate part of the guided part of the inner clamping member in the radial direction of the plate cylinder part is sandwiched between the guiding protrusions and slides in the axial direction and the radial direction of the plate cylinder part, and a part of the guided part of the inner clamping member, which protrudes from the guiding protrusions inward in the radial direction of the plate cylinder part is biased by the printing plate coupling member biasing device.

In this case, the guiding protrusions that constitute the printing plate coupling member guiding part can guide the guided part of the inner clamping member in the axial direction and the radial direction reliably and smoothly, and the printing plate coupling member biasing device can reliably bias the printing plate coupling member from the radially inner side.

For example, the printing plate coupling member biasing device is arranged so as to be slidable along a wall of the biasing device storing recess in a predetermined range in the axial direction of the plate cylinder part, and includes an inner slider in which a wedge surface oriented to the front end of the plate driving shaft is formed on an outer side in the radial direction of the plate cylinder part, an outer slider arranged between the inner slider and the inner clamping member so as to be slidable along the wall of the biasing device storing recess in a predetermined range in the radial direction of the plate cylinder part, the outer slider in which a wedge surface oriented to a bottom end of the plate driving shaft is formed on an inner side in the radial direction of the plate cylinder part so as to contact the wedge surface of the inner slider, an elastic member that biases the inner slider toward the front end of the plate driving shaft and a switching screw member that is screwed into the plate cylinder part and extends in the axial direction of the plate cylinder part, and the switching screw member moves to the bottom end of the plate driving shaft, thereby moving the inner slider in the axial direction of the plate driving shaft against a biasing force of the elastic member and moves to the front end of the plate driving shaft, thereby being away from the inner slider.

In this case, when the switching screw member is rotated in a predetermined bias releasing direction to be moved toward the bottom end of the plate driving shaft, the inner slider is pressed by the switching screw member and moves toward the bottom end against the biasing force of the elastic member, and the wedge surface of the inner slider moves away from the wedge surface of the outer slider. As a result, the outer slider moves inward in the radial direction. In this state, the printing plate unit can be readily attached to the plate cylinder. After the printing plate is attached to the plate cylinder, when the switching screw member is rotated in a biasing direction opposite to the bias releasing direction to be moved toward the front end of the plate driving shaft, the inner slider moves toward the front end by the biasing force of the elastic member, and the wedge surface of the inner slider pushes the wedge surface of the outer slider outward in the radial direction, thereby biasing the outer slider outward in the radial direction. When the inner slider moves toward the front end and reaches a predetermined position, the printing plate is pulled by the biasing force in the radially outward direction, which acts on the outer slider, and is fixed in close contact with the outer peripheral surface of the plate cylinder part. Even when the switching screw member is further moved toward the front end, the inner slider does not move any more, and the switching screw member is away from the inner slider. For this reason, the outer slider is biased by the inner slider outward in the radial direction, resulting in that the printing plate is pulled at all times. Thus, even when the printing plate is extended during printing due to change over time, the printing plate does not become loose.

By merely rotating the switching screw member to adjust the position of the switching screw member in the axial direction in this manner, attachment, detachment and fixing of the printing plate unit with respect to the plate cylinder part can be readily performed. Further, the attached printing plate can be pulled at all times, thereby preventing the printing plate from becoming loose.

For example, the inner slider is brought into close contact with a wall of the biasing device storing recess by a magnetic attraction force of permanent magnets, the outer slider is brought into close contact with a wall of the biasing device storing recess by the magnetic attraction force of permanent magnets, and the wedge surfaces of both the inner and outer sliders are brought into close contact with each other by the magnetic attraction force of permanent magnets.

The magnetic attraction force of the permanent magnets is determined to have a magnitude that allows relative movement between both members that are in close contact with each other, but prevents separation of the members.

In this case, both the inner and outer sliders are prevented from separating from the wall of the biasing device storing recess, and wedge surfaces of both the sliders are prevented from separating from each other due to the magnetic attraction force of the permanent magnets, resulting in that both the sliders can be smoothly moved.

For example, a guided part of the inner clamping member, which protrudes from the guiding protrusions inward in the radial direction of the plate cylinder part, is provided with movement restricting protrusions that contact the guiding protrusions, thereby preventing the inner clamping member from moving outward in the radial direction.

When the plate cylinder part to which the printing plate coupling member is attached rotates, the printing plate coupling member attempts to move outward in the radial direction by the centrifugal force. However, the movement restricting protrusions contact the guiding protrusions, thereby stopping movement of the printing plate coupling member to prevent the printing plate coupling member from bouncing out of the plate cylinder part.

The printer according to the present invention includes the above-mentioned printing plate attachment device.

Effect of the Invention

As described above, the printing plate unit according to the present invention can be readily attached/detached to/from the printer. Moreover, the printing plate detached from the printing plate coupling member can be stored in the form of a flat plate and therefore, a large space for storing the printing plate is not required.

In the printing plate attachment device and the printer according to the present invention, as described above, attachment, detachment, and fixing of the printing plate with respect to the printer can be achieved readily and accurately.

MODES FOR CARRYING OUT THE INVENTION

Some embodiments of the present invention will be described below with reference to figures.

Figure 1:
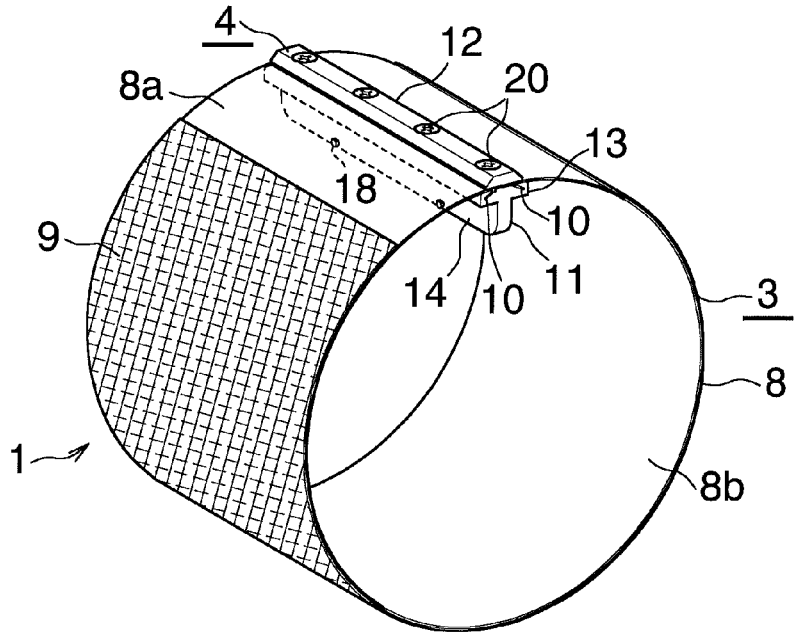
FIG. 1 is a perspective view showing a printing plate unit in accordance with an embodiment of the present invention.
Figure 2:
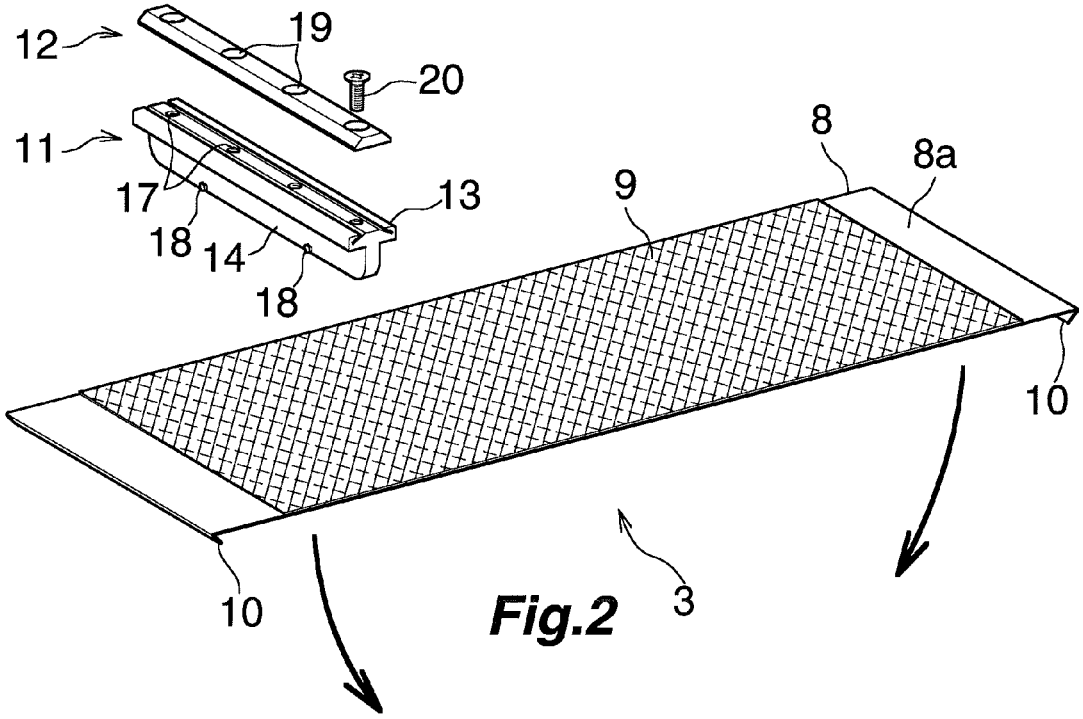
FIG. 2 is an exploded perspective view of the printing plate unit.
Figure 3:
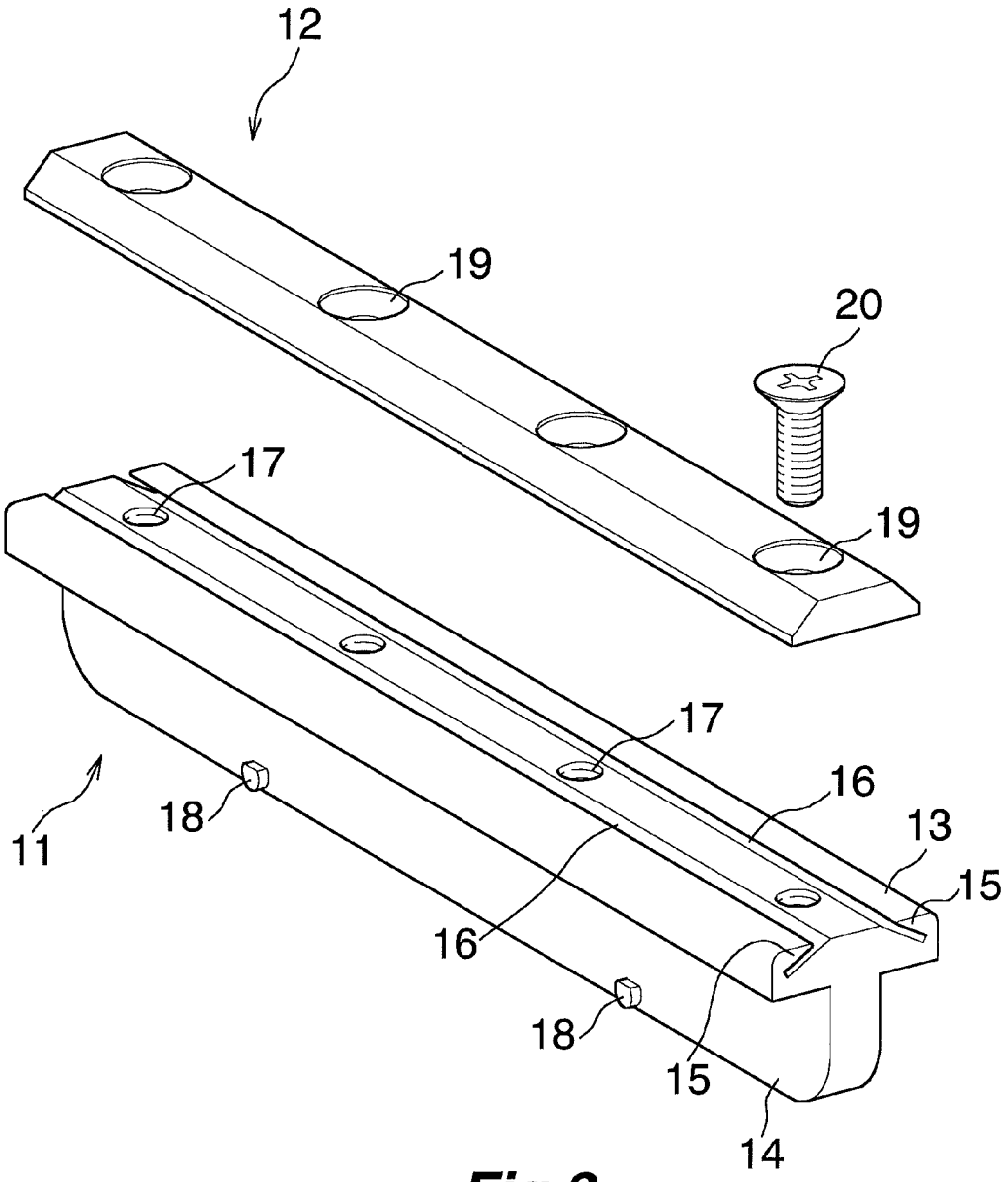
FIG. 3 is an exploded perspective view of a printing plate coupling member of the printing plate unit.
Figure 8:
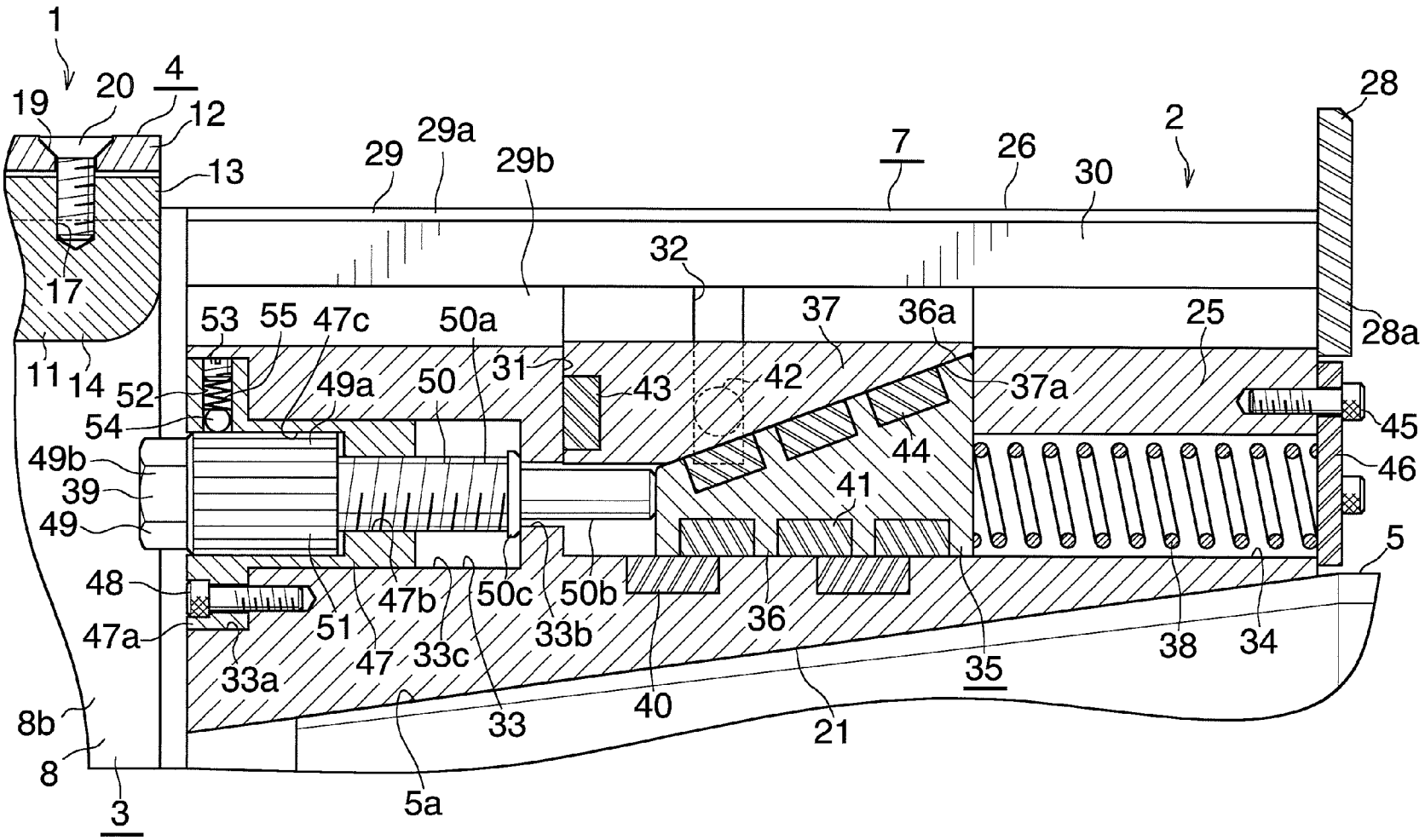
FIG. 8 is an enlarged vertical sectional view of the part in FIG. 7 in another state.
Figure 9:
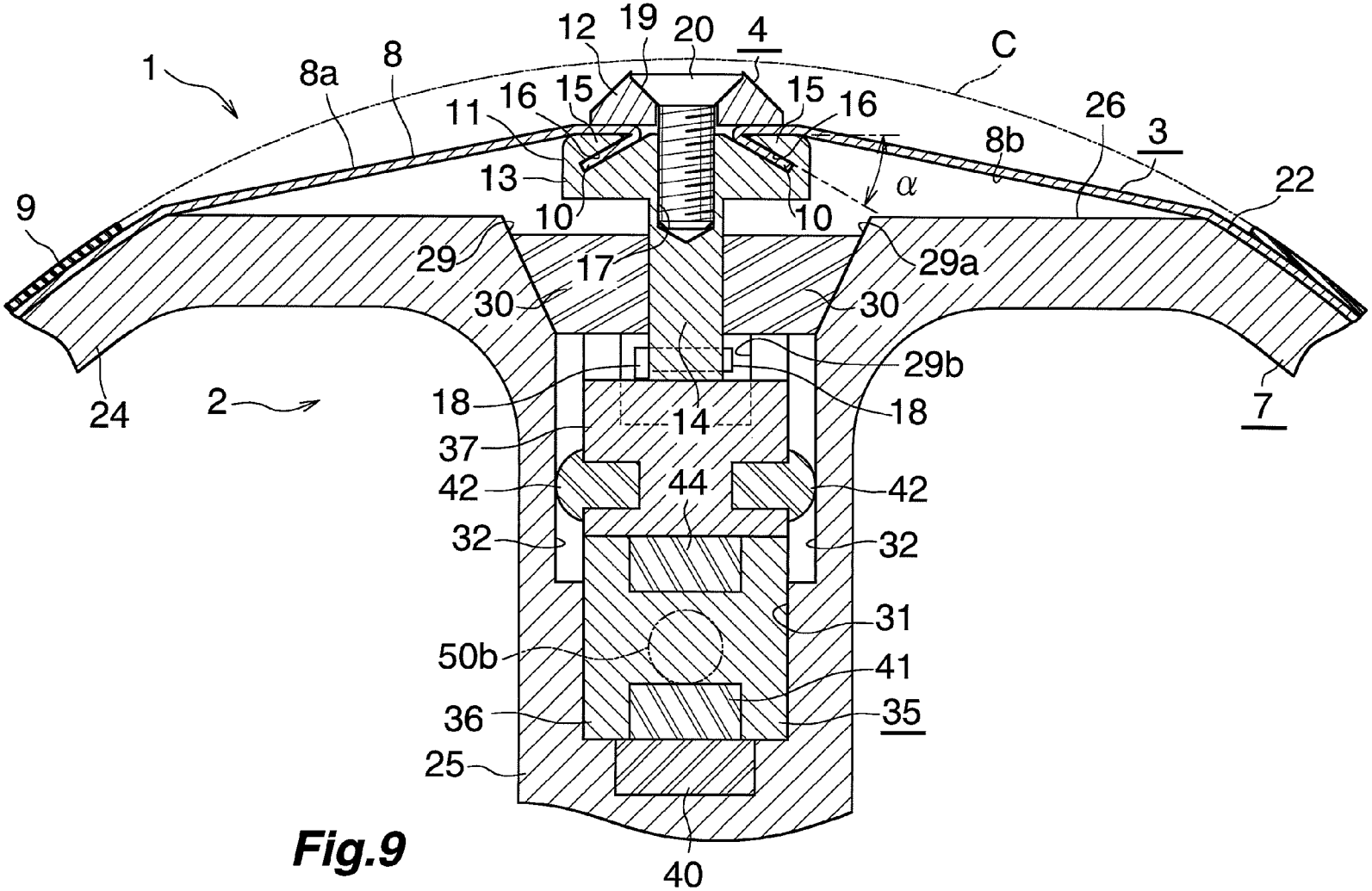
FIG. 9 is an enlarged horizontal sectional view taken along a line IX-IX in FIG. 4.
Figure 10:
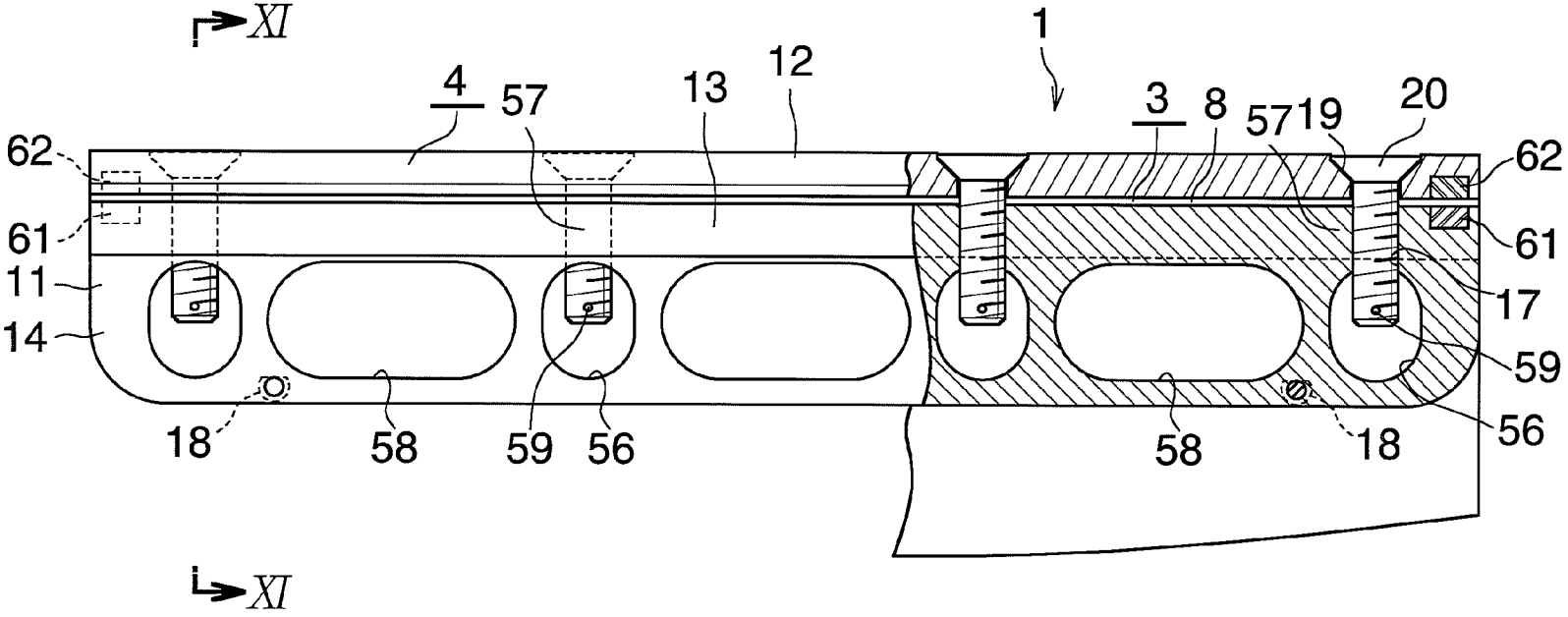
FIG. 10 is a vertical sectional view of a main part of a printing plate unit in accordance with another embodiment of the present invention.
Figure 12:
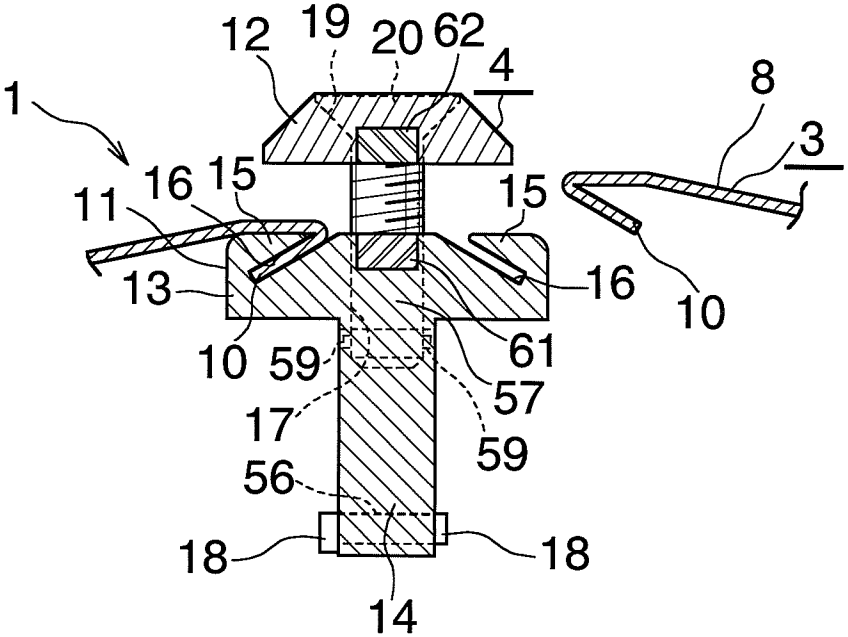
FIG. 12 is an enlarged horizontal sectional view of the part shown in FIG. 11 in another state.
Figure 11:
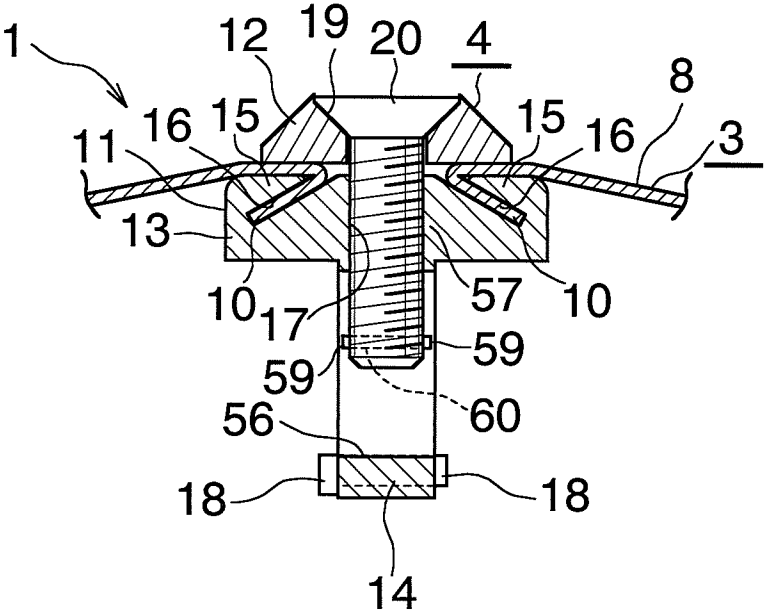
FIG. 11 is an enlarged horizontal sectional view taken along a line XI-XI in FIG. 10.

FIG. 1 to FIG. 3 show an embodiment of a printing plate unit (1), FIG. 4 to FIG. 9 show an embodiment of a printing plate attachment device (2), and FIG. 10 to FIG. 12 show another embodiment of the printing plate unit (1).

As shown in FIG. 1, the printing plate unit (1) is formed by coupling ends of a sheet-like printing plate (3) to each other with a printing plate coupling member (4) to be cylindrical. The coupling member (4) constitutes a part of the printing plate attachment device (2).

Figure 4:
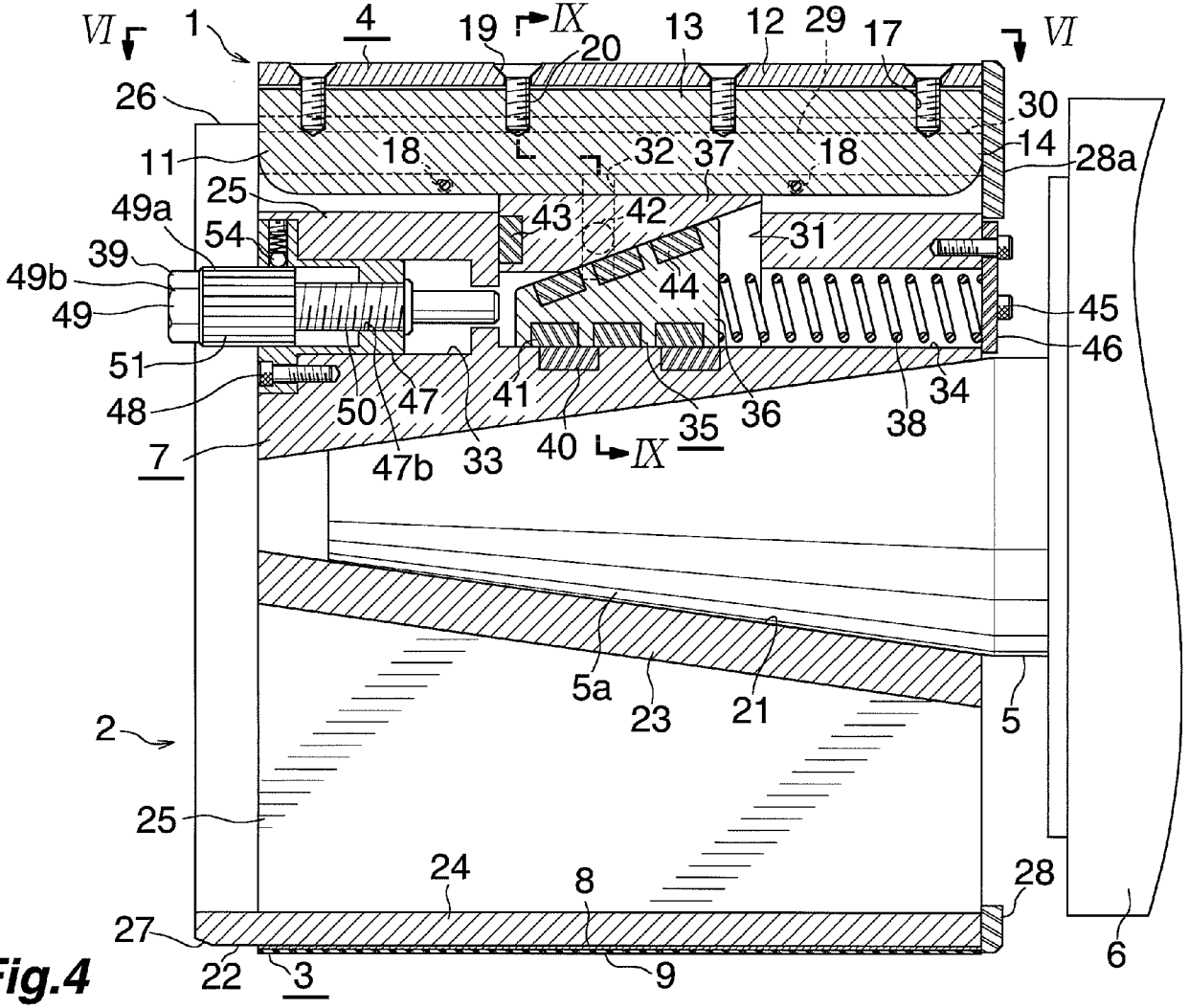
FIG. 4 is a vertical sectional view of a printing plate attachment device in a printer in accordance with an embodiment of the present invention.

As shown in FIG. 4, the printer includes a horizontally-arranged plate driving shaft (5). One end of the shaft (5) is rotatably supported by a bearing housing (6) provided in a frame of a printer not shown, and the other end of the shaft (5) is rotatably supported by a bearing housing not shown provided in the frame. The printing plate attachment device (2) is detachably fixed such that the one end of the shaft (5) protruding from the bearing housing (6), and includes a cylindrical plate cylinder part (7) fixed to the one end of the shaft (5).

In following description, it is assumed that the side of the end of the shaft (5) to which the printing plate attachment device (2) is fixed (left side in FIG. 4) is a front side, and the opposite side (right side in FIG. 4) is a rear side. It is assumed that the free end of the front end of the shaft (5) to which the printing plate attachment device (2) is fixed is a front end side, and the side of the opposite end supported by the bearing housing (6) is a bottom end side. Unless otherwise specified in this specification, axial direction, radial direction, and circumferential direction of the shaft (5), the plate cylinder part (7) and the printing plate unit (1) are referred to as merely, axial direction, radial direction, and circumferential direction, respectively.

Referring to FIG. 1 to FIG. 3, an embodiment of the printing plate unit (1) will be described below.

FIG. 1 is a perspective view of the printing plate unit (1), FIG. 2 is an exploded perspective view of the printing plate unit (1), and FIG. 3 is an exploded perspective view of the coupling member (4) constituting the printing plate unit (1). FIG. 4, FIG. 5, FIG. 7 and FIG. 9 show the printing plate unit (1) attached to the printing plate attachment device (2).

For the printing plate (3) in the form of a cylinder, the surface oriented to the outer side and the surface oriented to the inner side in the radial direction are a front surface and a back surface, respectively, and its circumferential direction and axial direction are defined as longitudinal direction and width direction, respectively.

The printing plate (3) includes a sheet (8) made of an elastic material. The sheet (8) may take any shape and in this example, is rectangular. A plate section (9) is provided on a part of a front surface (8*a*) of the sheet (8), and engaging protrusions (10) that protrude toward a back surface (8*b*) and extend in the axial direction are provided at respective longitudinal ends of the sheet.

The plate section (9) is provided on a predetermined place of the front surface (8*a*) except for both the ends of the sheet (8), and the front surface of the plate section (9) forms a plate surface.

The protrusions (10) may be integral with the sheet (8) or may be separated from the sheet (8). In this embodiment, the protrusions (10) are formed by bending both the ends of the sheet (8) toward the back surface (8*b*), and extend over the entire width of the sheet (8) integrally with the sheet (8).

Given that an angle $\alpha$ that each protrusion (10) forms with the adjacent part of the back surface (8*b*) of the sheet (8) (refer to FIG. 9) is a protrusion angle of each protrusion (10), it is preferred that the protrusion angle $\alpha$ is smaller than 90 degrees. The protrusion angle $\alpha$ of each protrusion (10) is, more preferably, in the range from 35 to 55 degrees, and most preferably, 45 degrees. In this embodiment, each end of the flat plate-like sheet (8) is bent toward the back surface (8*b*) by about 135 degrees, resulting in the protrusion angle $\alpha$ of about 45 degrees.

The sheet (8) is made of appropriate metal. In this embodiment, the sheet (8) is made of SS. The sheet (8) has such a thickness that it can be shaped like a cylinder and the cylindrical shape can be kept by its elastic force. In this embodiment, the thickness is about 0.26 mm. The plate section (9) is made of an appropriate synthetic resin material suitable for plate-making. The combined thickness of the sheet (8) and the plate section (9) is, in this embodiment, about 0.82 mm.

The coupling member (4) includes an inner clamping member (11) and an outer clamping member (12) that clamp both the longitudinal ends of the cylindrical printing plate (3) from inner and outer sides in the radial direction. In this embodiment, since the protrusions (10) of the printing plate (3) protrude toward the back surface (8*b*) of the sheet (8), the inner clamping member (11) engages with the protrusions (10) from the inner side in the radial direction, and the outer clamping member (12) is fixed to the inner clamping member (11) from the outer side in the radial direction, so that both the ends of the printing plate (3) are clamped. Both the clamping members (11), (12) extend in the axial direction.

As described later, the inner clamping member (11) is a guided member that serves as a guide when the printing plate unit (1) is attached to the plate cylinder part (7). The inner clamping member (11) includes a clamping part (13) that clamps the printing plate (3) and a guided part (14) formed integrally with the circumferential center of the radially inner surface of the clamping part (13). The clamping part (13) is shaped like a plate having a radial thickness that is smaller than the circumferential length (width). The guided part (14) is shaped like a plate having a circumferential thickness that is smaller than the radial length (height).

A radially outer part of the clamping part (13) is provided with two engagement parts (15) engaged with a part between the back surface (8*b*) and the protrusion (10) at each end of the printing plate (3). Two grooves (16) extending over the entire length of the clamping part (13) in the axial direction are formed in the flat surface of the clamping part (13) which faces the outer side in the radial direction, and a part between each groove (16) and the flat surface constitutes the engagement parts (15). Both the grooves (16) are inclined so as to be separated from each other toward the bottom side, and an angle that the groove (16) forms with the above-mentioned flat surface, that is, an angle of the engagement parts (15), is substantially equal to the protrusion angle $\alpha$ of the protrusions (10) of the printing plate (3). The width of each groove (16) is slightly larger than the thickness of the protrusions (10) of the printing plate (3). A plurality of threaded holes (17) having female screws are formed between both the grooves (16) in the flat surface of the clamping part (13) which faces the outer side in the radial direction and at predetermined intervals in the axial direction.

Movement restricting protrusions (18) that protrude toward both circumferential sides are provided at places near the radially inner end of the flat surface of the guided part (14) which faces both the circumferential sides. In this embodiment, the two protrusions (18) are provided on the flat surface with a relatively large distance therebetween in the axial direction. The protrusions (18) may be integral with the guided part (14), but in this embodiment, are formed of protrusions of movement restricting pins inserted into respective holes not shown formed in the guided part (14) by means of press-fitting or other appropriate means. Although not shown, for the reduction of the weight of the inner clamping member (11), a plurality of places of the guided part (14) is preferably removed.

The outer clamping member (12) is shaped like a plate having a radial thickness that is smaller than the length (width) of the circumferential direction. The radially inner surface of the clamping member (12) is flat. The circumferential center of the radially outer surface of the clamping member (12) is flat. The thickness of both circumferential ends of the clamping member (12) becomes smaller toward the circumferential outer side. Disc-like countersunk screw-insertion through holes (19) corresponding to the threaded holes (17) in the inner clamping member (11) are formed at the circumferential center of the outer clamping member (12). As described in detail later, both the clamping members (11), (12) are fixed to each other with a plurality of flat-head screws (20).

In assembling the printing plate unit (1) from the printing plate (3) and both the clamping members (11), (12), first, as represented by an arrow in FIG. 2, both the longitudinal ends of the plate-like printing plate (3) are bent toward the back surface to make the printing plate (3) cylindrical, and the protrusions (10) are fitted into the grooves (16) of the inner clamping member (11) to be engaged with the engagement parts (15). Then, as shown in FIG. 1, the outer clamping member (12) overlaps the inner clamping member (11) and ends of the printing plate (3) from the radially outer side, and the screws (20) are inserted into the through holes (19) and screwed into the threaded holes (17), thereby being fixed to the inner clamping member (11). In this manner, both the longitudinal ends of the printing plate (3) are clamped by both the clamping members (11), (12) and thus, are coupled to each other to constitute the cylindrical printing plate unit (1).

In disassembling the printing plate unit (1), the screws (20) are released to separate both the clamping members (11), (12) from each other, or both the clamping members (11), (12) are separated from each other by a required distance in the state where the screws (20) are fitted into the threaded holes (17) of the inner clamping member (11), and are detached from the printing plate (3). After disassembling, both the clamping members (11), (12) held with the screws (20) may be stored, or both the clamping members (11), (12) and the screws (20) may be separately stored.

Both the clamping members (11), (12) may be made of any appropriate metal, and in this embodiment, made of S55C.

Referring to FIG. 4 to FIG. 9, an embodiment of the printing plate attachment device (2) of the printer will be described below.

Figure 5:
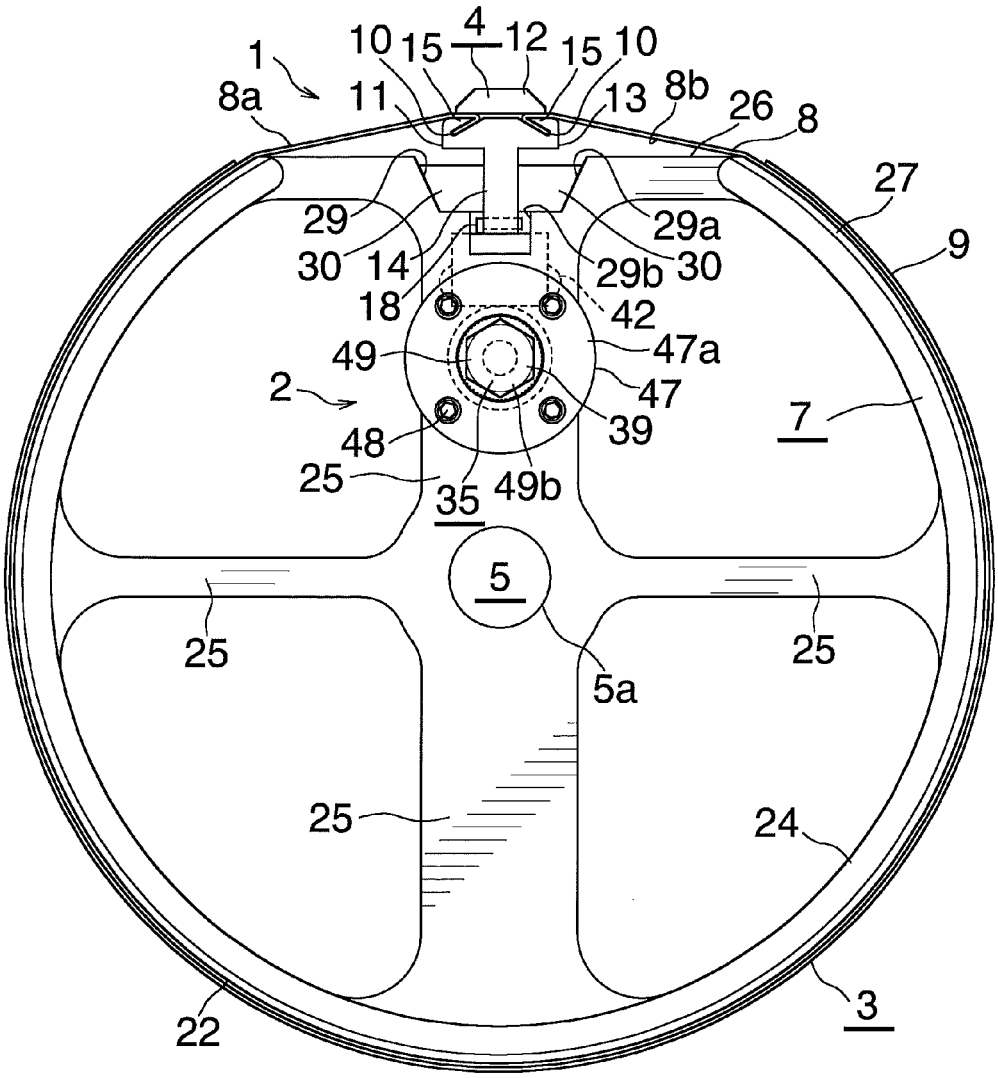
FIG. 5 is a front view of the printing plate attachment device in FIG. 4.
Figure 6:
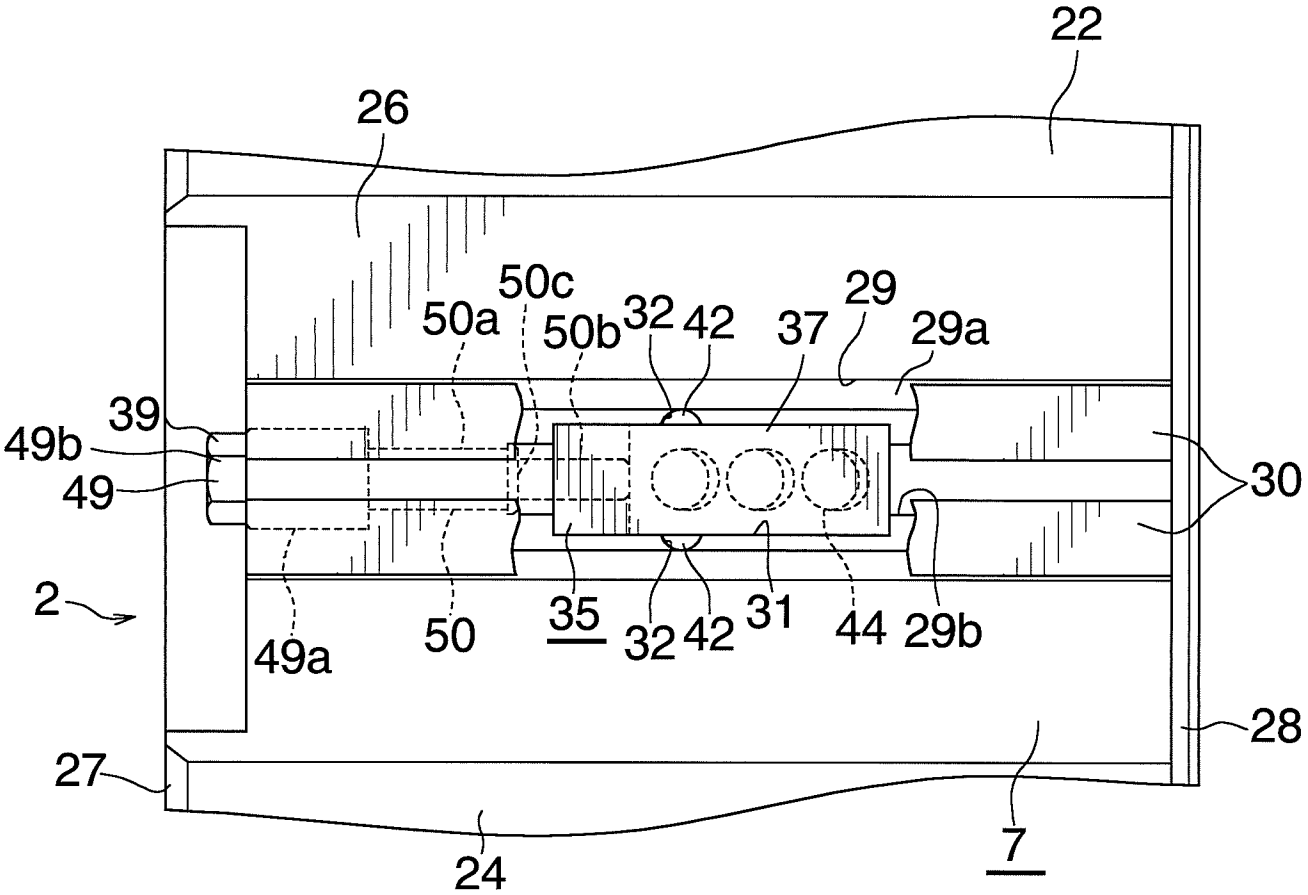
FIG. 6 is a partial view taken along a line VI-VI in FIG. 4 when viewed in the direction of an arrow.
Figure 7:
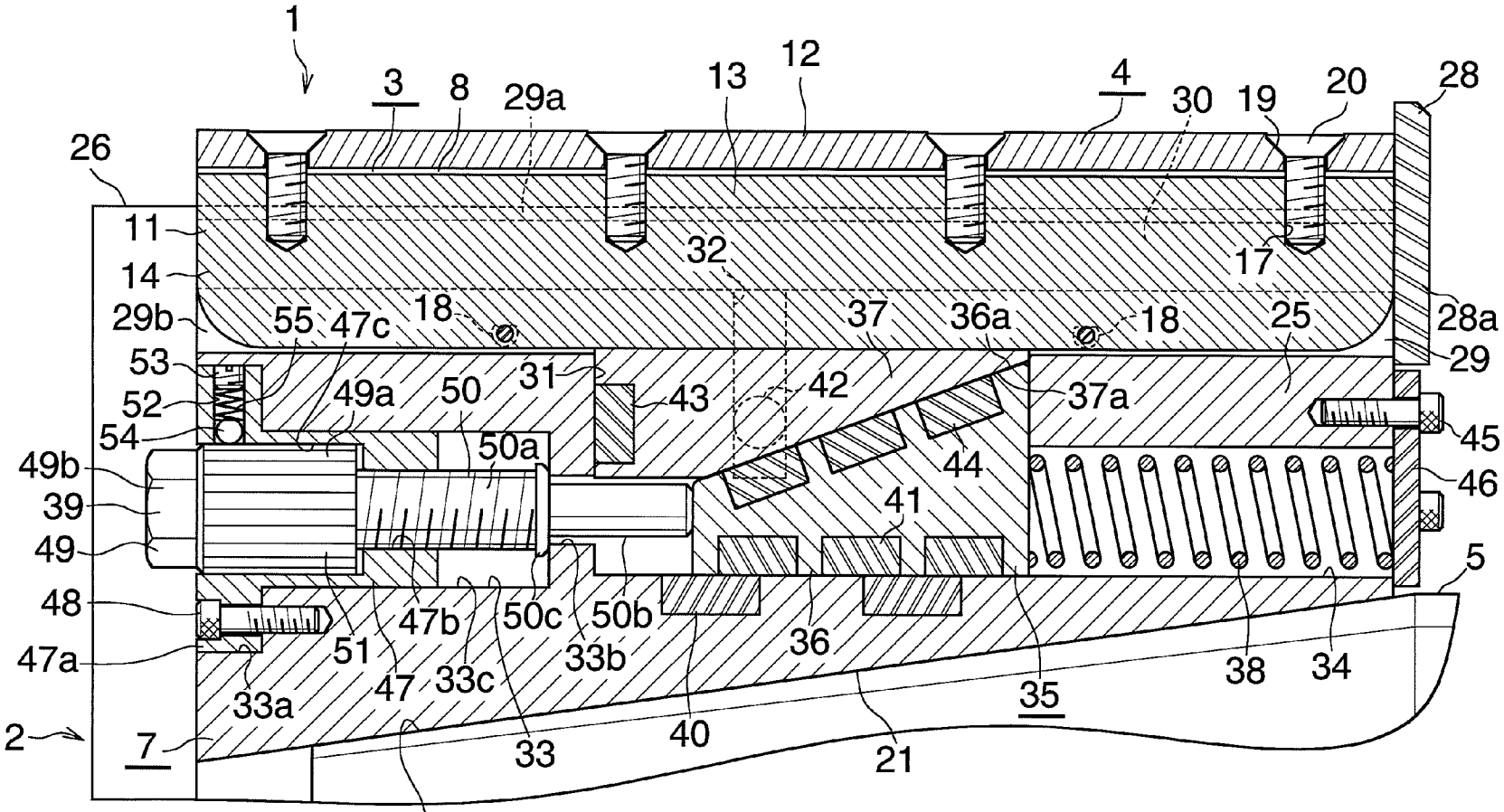
FIG. 7 is a partially enlarged vertical sectional view showing a part in FIG. 4.

FIG. 4 is a vertical sectional view of the printing plate attachment device (2), FIG. 5 is a front view of the printing plate attachment device (2) in FIG. 4, FIG. 6 is a partial view taken along a line VI-VI in FIG. 4 when viewed in the direction of an arrow, FIG. 7 is a partially enlarged vertical sectional view showing a part in FIG. 4, FIG. 8 is an enlarged vertical sectional view of the part in FIG. 7 in another state, and FIG. 9 is an enlarged horizontal sectional view taken along a line IX-IX in FIG. 4.

The plate driving shaft (5) of the printer is rotated in a predetermined direction at a predetermined speed by a publicly known driving means not shown. A tapered part (5*a*) is formed at a front end of the driving shaft (5) protruding from the bearing housing (6).

The plate cylinder part (7) is detachably fixed to the tapered part (5*a*) of the driving shaft (5). The plate cylinder part (7) has a tapered hole (21) having an inner diameter that becomes smaller toward the front side at its center, and a cylindrical plate attachment surface (22) that is concentric with the shaft (5) on its outer periphery. For the weight reduction, a plurality of places (in this embodiment, four places) of the plate cylinder part (7) in the circumferential direction is removed across the entire length in the forward and backward direction. Thus, the plate cylinder part (7) includes an inner tapered cylindrical part (23) having the tapered hole (21) in its inner periphery, an outer cylindrical part (24) having the plate attachment surface (22) on its outer periphery, and a plurality of coupling parts (25) that couples the cylindrical parts to each other. The plate cylinder part (7) is fixed to the shaft (5) by means of a screw or the like not shown in the state where the tapered part (5*a*) of the shaft (5) is fitted into the tapered hole (21), and rotates integrally with the shaft (5).

The plate cylinder part (7) may be made of appropriate metal such as cast iron, and in this embodiment, made of ductile cast iron as a magnetic material.

In a part corresponding to one coupling part (25) (located in the upper side in FIG. 5) of the outer cylindrical part (24) of the plate cylinder part (7), a part of the cylindrical surface is removed to form a flat groove formation surface (26), and the outer cylindrical part (24) except for the groove formation surface (26) forms the plate attachment surface (22). The plate section (9) of the printing plate (3) is formed on the sheet (8) that comes into close contact with the plate attachment surface (22) when the printing plate unit (1) is attached to the plate cylinder part, and the circumferential length of the plate attachment surface (22) is larger than that of the plate section (9). The tapered part (27) is formed at the front end of the plate attachment surface (22) by chamfering, and the outer diameter of the plate attachment surface (22) except for the tapered part (27) is constant over the entire length.

An annular stopper member (28) that slightly extends outward from the plate attachment surface (22) in the radial direction is fixed to the outer periphery of the rear end surface of the outer cylindrical part (24) of the plate cylinder part (7) by an appropriate means such as a screw not shown. The stopper member (28) constitutes the axial positioning stopper part. A receiving part (28*a*) that protrudes inward in the radial direction is formed integrally with a part of the stopper member (28) (located in the upper side in FIG. 5), which corresponds to the circumferential center of the groove formation surface (26). The extending distance of the stopper member (28) from the outer peripheral surface of the plate attachment surface (22) is smaller than the combined thickness of the sheet (8) of the printing plate (3) and the plate section (9), and is larger than the thickness of the sheet (8). In this embodiment, it is about 0.5 mm.

A printing plate coupling member storing groove (29) into which the inner clamping member (11) of the printing plate coupling member (4) of the printing plate unit (1) is fitted is formed at the circumferential center of the groove formation surface (26) corresponding to the coupling parts (25) over the entire length in the axial direction. The groove (29) includes a trapezoidal groove part (29*a*) at the radially outer side having the circumferential width that becomes larger toward the radially outer side, and a rectangular groove part (29*b*) formed on the bottom of the trapezoidal groove part (29*a*). A circumferential width of the rectangular groove part (29*b*) is slightly smaller than a width of the bottom of the trapezoidal groove part (29*a*), and is slightly larger than a circumferential width of the guided part (14) of the inner clamping member (11). A rear end of the groove (29) is covered with the receiving part (28*a*) of the stopper member (28).

A pair of guiding members (30) constituting a printing plate coupling member guiding part that guides the inner clamping member (11) in the axial direction and guides the inner clamping member (11) to move in a predetermined range in the radial direction are fixed to the bottom of the trapezoidal groove part (29*a*). The guiding members (30) are fixed to the bottom of the trapezoidal groove part (29*a*) with an appropriate means such as screws not shown in close contact with the bottom wall and both side walls of the trapezoidal groove part (29*a*) over the entire length in the axial direction to constitute guiding protrusions. The opposed surfaces of the guiding members (30) in the circumferential direction are flat surfaces that are parallel to one flat surface containing the center of the plate cylinder part (7), and a width between the opposed surfaces is smaller than a width of the rectangular groove part (29*b*) and is slightly larger than a width of the guided part (14) of the inner clamping member (11). It is preferred that a difference between the width between the opposed surfaces of the guiding members (30) and the width of the rectangular groove part (29*b*) is made as small as possible so as not to prevent smooth movement of the guided part (14) of the inner clamping member (11). A radial height of the guiding members (30) is smaller than a distance between the radially inner surface of the clamping part (13) of the inner clamping member (11) and the movement restricting protrusion (18).

A biasing device storing recess (31) having a width that is slightly larger than a circumferential width of the rectangular groove part (29*b*) is formed at the axial center of the bottom of the trapezoidal groove part (29*a*). Both the vertical cross section (refer to FIG. 8) and the horizontal cross section (refer to FIG. 9) of the recess (31) are rectangular. The recess (31) has a radial depth that is larger than a circumferential width and an axial length that is larger than the depth. Opposed guiding grooves (32) that each extend in the radial direction and reach a radially outer end of the recess (31) are formed in both side walls of the recess (31).

A screw member storing hole (33) that extends from the front end of the coupling part (25) to the recess (31) is formed in a front part of the coupling part (25) in which the recess (31) is formed. The hole (33) includes a front end as a large-diameter part (33*a*) having a relatively small axial length, a rear end as a small-diameter part (33*b*) having a relatively small axial length, and an immediate-diameter part (33*c*) having a relatively large axial length between the large-diameter part (33*a*) and the small-diameter part (33*b*). An elastic member storing hole (34) extending from the recess (31) to the rear end of the coupling part (25) is formed in a rear part of the coupling part (25).

A printing plate coupling member biasing device (35) that biases the guided part (14) of the inner clamping member (11) of the printing plate unit (1) which is attached to the plate cylinder part (7) as described later outward in the radial direction is provided at the recess (31) and the two holes (33), (34).

The biasing device (35) includes an inner slider (36) and an outer slider (37) that are disposed in the recess (31), a helical compression spring (38) disposed in the hole (34), and a switching screw member (39) disposed in the hole (33).

The inner slider (36) is shaped like a trapezoidal thick plate having a smaller radial height toward the front side, and its axial length is smaller than the length of the recess (31). The inner slider (36) is arranged so as to be slidable in the axial direction between a front end position where the inner slider contacts a front end wall of the recess (31) and a rear end position where the inner slider contacts a rear end wall of the recess (31) along a bottom wall and both side walls of the recess (31). A wedge surface (36*a*) oriented to the front side is formed on the whole of the radially outer side of the inner slider (36). In this embodiment, the inner slider (36) is made of S55C.

A plurality of front and rear first permanent magnets (40) is embedded in the bottom wall of the recess (31). A plurality of front and rear second permanent magnets (41) is embedded in the radially inner surface of the inner slider (36). The first permanent magnets (40) and the second permanent magnets (41) are arranged so as to be attracted to each other, and due to the magnetic attraction force, the inner slider (36) can be slidable forward and backward in close contact with the bottom wall of the recess (31).

The outer slider (37) is arranged on the radially outer side of the inner slider (36). The outer slider (37) is shaped like a trapezoidal thick plate having a smaller radial height toward the rear side, and its axial length is slightly smaller than an axial length of the recess (31). A wedge surface (37*a*) oriented to the rear side is formed on a place except for the front part of the radially inner side of the outer slider (37) so as to be opposed to the wedge surface (36*a*) of the inner slider (36). In this embodiment, the outer slider (37) is made of S55C.

Guiding protrusions (42) that protrude to both circumferential sides and are fitted into the guiding grooves (32) of the recess (31) are provided at respective positions on both the circumferential sides of the outer slider (37). The protrusions (42) may be formed integrally with the inner slider (37), and in this embodiment, are formed of parts protruding from the movement restricting pins press-fitted into the holes in the inner slider (37) by any appropriate means. The outer slider (37) can slide in the radial direction along both of the front and rear end walls and both side walls of the recess (31) in the state where the protrusions (42) are fitted into the guiding grooves (32), and the wedge surface (37*a*) can mutually slide with the wedge surface (36*a*) of the inner slider (36). A third permanent magnet (43) is embedded in a front end surface of the outer slider (37), and due to the magnetic attraction force, the inner slider (37) slides in the radial direction in close contact with the front end wall of the recess (31). A fourth permanent magnets (44) are embedded in the wedge surface (36*a*) of the inner slider (36), and due to the magnetic attraction force, the inner and outer sliders (36), (37) slide in the state where the wedge surfaces (36*a*), (37*a*) are in close contact with each other.

A rear end of the elastic member storing hole (34) is covered with a cap (46) fixed to the coupling part (25) with a bolt (45). A spring (38) in the compressed state is stored between the cap (46) and a rear end surface of the inner slider (36) over the hole (34) and the recess (31) to constitute the elastic member that biases the inner slider (36) forward.

A staged cylindrical housing (47) is fitted into the screw member storing hole (33). A rear part of the housing (47) is closely fitted to the immediate-diameter part (33*c*) of the hole (33), and an outward-directed flange (47*a*) formed at a front end of the housing (47) is fitted to the large-diameter part (33*a*) of the hole (33) and is fixed to the coupling part (25) with a plurality of bolts (48). A rear end of the housing (47) constitutes a small-diameter female screw (47*b*) having a female screw (left-hand screw) on its inner periphery, and a part in front of the female screw (47*b*) constitutes a large-diameter part (47*c*) having a larger inner diameter than the female screw (47*b*).

The screw member (39) is fixed with an appropriate means such as a screw so as not to rotate and move in the axial direction by fitting a front end of a rear screw shaft (50) extending in the forward and backward direction to a rear end of a front knob (49) extending in the forward and backward direction.

The knob (49) is obtained by forming a short polygonal column part (49*b*) integrally with a front end of a relatively long cylindrical column part (49*a*). A plurality of positioning grooves (51) that each have an arcuate cross section and extend in the axial direction are formed in the outer peripheral surface of the cylindrical column part (49*a*) at regular intervals in the circumferential direction of the cylindrical column part (49*a*).

The screw shaft (50) is obtained by forming a cylindrical part (50*b*) having a smaller diameter than a male screw (50*a*) integrally with a rear end of the male screw (50*a*) fixed to a rear end of the knob (49). A flange-like stopper part (50*c*) having a slightly larger diameter than the male screw (50*a*) is formed integrally with a boundary between the male screw (50*a*) and the cylindrical part (50*b*). A male screw (left-hand screw) corresponding to the female screw (47*b*) of the housing (47) is formed on the outer periphery of the male screw (50*a*).

The male screw (50*a*) of the screw shaft (50) is engaged with the female screw (47*b*) of the housing (47), and the cylindrical column part (49*a*) of the knob (49) is fitted into the large-diameter part (47*c*) of the housing (47) so as to be capable of rotating and moving in the axial direction. The stopper part (50*c*) of the screw shaft (50) is located between the housing (47) and the small-diameter part (33*b*) of the screw member storing hole (33) of the coupling parts (25), and the cylindrical part (50*b*) of the screw shaft (50) is fitted into the small-diameter part (33*b*) with a small gap therebetween in the radial direction.

By rotating the polygonal column part (49*b*) of the screw member (39), the whole of the screw member (39) can move forward and backward between the front end position where the stopper part (50*c*) contacts a rear end surface of the housing (47) and a rear end position where the stopper part (50*c*) contacts a front end surface of the small-diameter part (33*b*) of the screw member storing hole (33). As shown in FIG. 4, in the state where the screw member (39) moves to the front end position, a front part of the cylindrical column part (49*a*) of the knob (49) protrudes forward from the front end surface of the coupling part (25), and a rear part of the cylindrical column part (49*a*) is located inner from the flange (47*a*) of the housing (47). A rear end of the cylindrical part (50*b*) of the screw shaft (50) corresponds to, or is located slightly in front of the rear end surface of the small-diameter part (33*b*) of the screw member storing hole (33). As shown in FIG. 8, in the state where the screw member (39) moves to the rear end position, the cylindrical column part (49*a*) of the knob (49) is almost wholly fitted into the large-diameter part (47*c*) of the housing (47), and the polygonal column part (49*b*) protrudes forward from the front end surface of the coupling part (25). The cylindrical part (50*b*) of the screw shaft (50) protrudes backward from the rear end surface of the small-diameter part (33*b*) of the screw member storing hole (33), and is located in the recess (31).

A ball storing hole (52) penetrating the flange (47*a*) in the radial direction is formed in one place of the flange (47*a*) of the housing (47). An end of the hole (52) on the side of the outer periphery of the flange (47*a*) is covered with a cap (53). A positioning ball (54) is stored in the hole (52) so as to be movable along the hole (52), and a helical compression spring (55) in the compressed state, which constitutes a ball biasing elastic member, is stored in the hole (52) between the cap (53) and the ball (54). Due to the elastic force of the spring (55), the ball (54) is engaged with a groove (51) in the cylindrical column part (49*a*) of the knob (49) in contact with the groove (51) at all times, thereby preventing the screw member (39) from freely rotating.

When being rotated to the left when viewed from the front, the screw member (39) moves backward, thereby moving the inner slider (36) to the rear side against the elastic force of the spring (38). Thereby, the outer slider (37) moves to the radially inner side. FIG. 8 shows the state where the inner slider (36) moves to the rear end position, and the outer slider (37) moves to an innermost position. Conversely, when being rotated to the right when viewed from the front, the screw member (39) moves forward, and the inner slider (36) moves forward due to the elastic force of the spring (38). Thereby, the outer slider (37) moves to the radially outer side. FIG. 4 shows the state where the inner slider (36) moves to a position near the front end position, and the outer slider (37) moves to a position near an outermost position.

The printing plate (3) in the form of the printing plate unit (1) is attached to the attachment device (2) as follows.

When the printing plate unit (1) is attached to the attachment device (2), as shown in FIG. 8, the outer slider (37) is located at the innermost position. In this state, the coupling member (4) is inserted into the groove (29) from the front, and the printing plate (3) is fitted around the plate attachment surface (22) of the plate cylinder part (7) such that a part radially outer from the protrusion (18) of the inner clamping member (11) is fitted between the guiding members (30). At this time, relationship between the plate cylinder part (7) and the printing plate unit (1) in size is determined such that a gap is generated between the printing plate (3) and the plate attachment surface (22). Next, the coupling member (4) is moved backward under guiding of the guiding members (30) so as to come into contact the receiving part (28*a*) of the stopper member (28). Since the printing plate unit (1) is positioned in the axial direction in this manner, the screw member (39) is rotated to the right to be located at the front end position shown in FIG. 4. When the screw member (39) moves forward, the inner slider (36) moves forward in contact with the cylindrical part (50*b*) of the screw member (39) due to the elastic force of the spring (38). Thus, the outer slider (37) moves to the radially outer side and contacts the guided part (14) of the inner clamping member (11), thereby moving the coupling member (4) to the radially outer side. When moving to the radially outer side, the coupling member (4) pulls the printing plate (3) to cause the printing plate (3) to be close contact with the plate attachment surface (22) of the plate cylinder part (7). When the coupling member (4) moves to the radially outer side to some extent and the tensile force of the printing plate (3) and the elastic force of the spring (38) are in balance, as shown in FIG. 4 and FIG. 9, the coupling member (4) stops. When the coupling member (4) stops, the outer slider (37) and the inner slider (36) also stop. As a result, attachment of the printing plate (3) is completed, and the printing plate (3) is fixed to the plate attachment surface (22) in close contact, thereby being prevented from moving both in the axial direction and in the circumferential direction. At this time, the screw member (39) is ahead of the inner slider (36), and the printing plate (3) is pulled by the biasing force of the outer slider (37). In such state where the printing plate unit (1) is attached to the plate cylinder part (7), and the printing plate (3) is in close contact with the plate attachment surface (22), relationship between the plate cylinder part (7) and the printing plate unit (1) in size is determined such that the coupling member (4) does not move to the radially outer side of a virtual cylindrical surface (C) (refer to FIG. 9) including the outer peripheral surface of the plate attachment surface (22).

At printing, as described above, the plate cylinder part (7) is rotated in the state where the printing plate unit (1) fixed to the plate cylinder part (7). At this time, the guided part (14) of the inner clamping member (11) of the printing plate unit (1) is sandwiched between the pair of guiding members (30) of the plate cylinder part (7), and the printing plate (3) is brought into close contact with the plate attachment surface (22) of the plate cylinder part (7) by a radially outward force that acts from the coupling member biasing device (35) onto the coupling member (4), thereby preventing displacement of the printing plate (3). Further, since near both the end parts of the printing plate (3) is clamped between the inner clamping member (11) and the outer clamping member (12) in the state where the protrusions (10) of the printing plate (3) are engaged with the engagement parts (15) of the inner clamping member (11), both the ends of the printing plate (3) is reliably fixed to the coupling member (4), and even when the printing plate (3) is pulled, the printing plate (3) is never detached from the coupling member (4). Since the ball (54) is in press-contact with the groove (51) in the knob (49) of the screw member (39) due to the elastic force of the spring (55), the screw member (39) never rotates. As described above, since the printing plate (3) is pulled by the outer slider (37), even when the printing plate (3) is extended due to change with time, the printing plate (3) does not become loose. Since the coupling member (4) of the printing plate unit (2) is located on the radially inner side of the virtual cylindrical surface (C), and the stopper member (28) does not extend outward in the radial direction from the outer peripheral surface of the plate section (9), the coupling member (4) and the stopper member (28) do not interfere printing. During rotation of the plate cylinder part (7), the centrifugal force acts on the coupling member (4). If the printing plate (3) is broken, restraint of the coupling member (4) in the radial direction is released, resulting in that the coupling member (4) moves outward in the radial direction along the guiding members (30) by the centrifugal force. However, the protrusion (18) of the coupling member (4) contacts the guiding members (30), thereby stopping movement of the coupling member (4) and preventing the coupling member (4) from springing out from the plate cylinder part (7).

When the printing plate unit (1) attached to the plate cylinder part (7) as described above is detached, in the state where the plate cylinder part (7) is stopped, the screw member (39) is rotated to the left and as shown in FIG. 8, the inner slider (36) is moved to the rear end position. As a result, since the outer slider (37) moves to the innermost position, and a gap is generated between the printing plate (3) and the plate attachment surface (22), the printing plate unit (1) can be moved in the axial direction to be easily detached from the front end of the plate cylinder part (7).

When the printing plate unit (1) is not used, as described above, both the clamping members (11), (12) may be separated or away from each other and removed from the printing plate (3), and the printing plate (3) may be stored in the form of a flat plate. As a result, a large space for storage of the printing plate (3) is not required.

Referring to FIG. 10 to FIG. 12, another embodiment of the printing plate unit (1) will be described below.

FIG. 10 is a vertical sectional view of a main part of the printing plate unit, FIG. 11 is an enlarged horizontal sectional view taken along a line XI-XI in FIG. 10, and FIG. 12 is an enlarged horizontal sectional view of the part shown in FIG. 11 in another state. In FIG. 10 to FIG. 12, the same components as those in the embodiments are given the same reference numerals.

Like the former embodiment, in this embodiment, the printing plate unit (1) includes the printing plate (3) and the coupling member (4).

In both the embodiments, the printing plate (3) is the same.

As in the above-mentioned embodiment, the coupling member (4) includes the inner clamping member (11), the outer clamping member (12), and the flat-head screws (20) constituting the clamping screw members.

This embodiment is the same as the former embodiment in the shape of the outer clamping member (12) and in that the screw-insertion through holes (19) are provided.

In this embodiment like the former embodiment, the inner clamping member (11) includes the clamping part (13) and the guided part (14). However, a threaded hole-forming perforated part (56) penetrating the guided part (14) in the circumferential direction are formed at a plurality of places of the guided part (14) in the axial direction, and a part of the inner clamping member (11) on the radially outer side of each perforated part (56) constitute a threaded hole-forming part (57). The threaded holes (17) as in the former embodiment are formed to penetrate the respective threaded hole-forming parts (57) in the radial direction. A weight-reducing perforated part (58) penetrating a part of the guided part (14) between the threaded hole-forming perforated parts (56) in the circumferential direction is formed.

Each screw (20) in this embodiment is the same as the screw in the former embodiment except that it is provided with a retaining stopper (59). As in the former embodiment, both the clamping members (11), (12) are fixed by means of the screws (20). In the state where the screw (20) is fastened, a front end of the screw (20) protrudes into the perforated part (56). In this state, the stopper (59) is provided at the front end of the screw (20) away from the threaded hole (17) inward in the radial direction. The stopper (59) only needs to fill at least one place of the groove in the screw (20). In this embodiment, a front end of a stopper pin (60) fixed to a hole penetrating the front end of the screw (20) in the radial direction by means of press-fitting or the like constitutes the two stoppers (59). The pin (60) is fixed to the front end of the screw (20) in the state where the screw (20) couples both the clamping members (11), (12) to each other and protrudes into the perforated part (56) and thereafter, both the clamping members (11), (12) are kept to be coupled to each other with the screw (20). The stopper (59) protrudes from the hole of the screw (20) to fill the thread groove. A front end of the stopper (59) is located at the substantially same position as the screw thread of the screw (20) or the position slightly protruding from the screw thread, wherever the screw (20) is located in the rotating direction, the screw (20) and the stopper (59) does not protrude from both the circumferential surface of the guided part (14).

Permanent magnets (61), (62) are embedded at one or more places of both the clamping members (11), (12), preferably, two places in the axial direction, in this embodiment, two places near both ends in the axial direction, on opposing surfaces of both the clamping members (11), (12). At each place, the permanent magnets (61), (62) are arranged such that the same magnetic poles are opposed to and repel each other. Due to the magnetic repelling force of the permanent magnets (61), (62), the outer clamping member (12) stops at at least a portion of one screw (20) in the state where the countersunk part of the hole (19) is in contact with the head of the screw (20). Then, when the screw (20) is released, the outer clamping member (12) is separated from the inner clamping member (11) with the radially outward movement of the screw (20) by the magnetic repelling force. For this reason, there is no need to separate the outer clamping member (12) from the inner clamping member (11) by hand. When the screw (20) is released until the stopper (59) reaches the radially inner end of the threaded hole (17), the screw (20) cannot be released any more, and both the clamping members (11), (12) are kept to be attached to the screw (20). When the screw (20) is fastened, with the radially inward movement of the screw (20), the outer clamping member (12) gets closer to the inner clamping member (11) against the magnetic repelling force of the permanent magnets (61), (62).

In assembling the printing plate unit (1), first, as shown in FIG. 12, the screw (20) is released to separate the outer clamping member (12) from the inner clamping member (11) by a required distance. Then, the protrusions (10) of the cylindrical printing plate (3) are fitted into the grooves (16) of the inner clamping member (11), thereby being engaged with the engagement parts (15). In this state, the screw (20) is fastened, as shown in FIG. 11, causing both the clamping members (11), (12) to clamp both the ends of the printing plate (3).

In disassembling the printing plate unit (1), the screw (20) is released, as shown in FIG. 12, to separate the outer clamping member (12) from the inner clamping member (11), thereby detaching the printing plate (3) from the inner clamping member (11). After disassembling, the coupling member (4) can be stored in the state where both the clamping members (11), (12) are coupled to each other with the screws (20), which is easy to handle.

The printing plate unit (1) can be attached to the same printing plate attachment device (2) as that in the former embodiment. Attachment/detachment of the printing plate unit (1) to/from the attachment device (2) can be performed in the same manner as in the former embodiment. Since the screws (20) and the stopper (59) do not protrude outward from both the circumferential surface of the guided part (14) of the inner clamping member (11) and therefore, do not obstruct attachment, printing and detachment.

The configurations of the printing plate, the printing plate unit, the printer, the printing plate attachment device, and the like are not limited to those in the above-mentioned embodiments, and may be appropriately changed.

For example, in the above-mentioned embodiment, since both the protrusions (10) of the printing plate (3) protrude toward the back surface, in the state where both the protrusions (10) are engaged with the inner clamping member (11), the outer clamping member (12) can overlap the radially outer side of the inner clamping member (11) to easily fix both the ends of the printing plate (3). However, both the protrusions (10) of the printing plate (3) may protrude toward the front surface. In this case, both the protrusions (10) engage with the engagement parts formed on the outer clamping member (12). Both the protrusions (10) of the printing plate (3) may protrude in opposite directions. In this case, the protrusion (10) protruding toward the back surface engages with the engagement part formed on the inner clamping member (11), and the protrusion (10) protruding toward the front surface engages with the engagement part formed on the outer clamping member (12).

INDUSTRIAL AVAILABILITY

The present invention is suitably applied to the printing plate unit in the printer. With use of the printing plate unit according to the present invention, while the printing plate unit is not used, the printing plate in the form of a flat plate can be stored, thereby requiring no large storage space for the printing plate.

DESCRIPTION OF REFERENCE NUMERALS (1): printing plate unit, (3): printing plate, (4): printing plate coupling member, (5): plate driving shaft, (7): plate cylinder part, (8): sheet, (9): plate section, (10): engaging protrusion, (11): inner clamping member, (12): outer clamping member, (13): clamping part, (14): guided part, (15): engagement part, (26): groove formation surface, (28): stopper member (axial positioning stopper part), (29): printing plate coupling member storing groove, (30): guiding member (printing plate coupling member guiding part), (31): biasing device storing recess, (35): printing plate coupling member biasing device, (36): the inner slider, (**36*a*): wedge surface, (37): the outer slider, (37*a*): wedge surface, (38): helical compression spring (elastic member), (39): switching screw member, (40), (41), (43), (44), (61), (62): permanent magnet, (56): perforated part, (57): threaded hole-forming part, (59**): stopper

The invention claimed is:

1. A printing plate unit attached to a printing plate attachment device of a printer that includes a plate cylinder part, the printing plate unit comprising:

a printing plate in which a plate section is provided on a part of a front surface of a sheet made of an elastic material, and engaging protrusions that protrude toward a back surface or a front surface and extend in a width direction are provided at longitudinal ends of the printing plate; and a printing plate coupling member that is detachable from the printing plate, and engages with the engaging protrusions of the printing plate which is formed to be cylindrical to couple the longitudinal ends of the cylindrical printing plate to each other, wherein the printing plate coupling member includes an inner clamping member and an outer clamping member that clamp the longitudinal ends of the cylindrical printing plate at radially inner and outer sides, wherein attachment and detachment of the printing plate unit to and from the plate cylinder part fixedly provided at a plate driving shaft of a printer is performed in a state in which the printing plate is kept cylindrical by the printing plate coupling unit, and in a state in which the printing plate unit is detached from the plate cylinder part, with the printing plate coupling member detachable from the printing plate and the printing plate storable in the form of a flat plate, wherein the printing plate coupling member includes screw members, wherein a plurality of threaded holes are formed in the inner clamping member, and screw-insertion through-holes corresponding to the threaded holes are formed in the outer clamping member, wherein the outer clamping member overlaps the inner clamping member and the ends of the printing plate at the radially outer side, and the screw members are inserted into the through-holes and screwed into the threaded holes, thereby being fixed to the inner clamping member, and wherein threaded hole-forming parts each having a predetermined thickness in the radial direction of the cylindrical printing plate are formed at a plurality of places of the inner clamping member, a threaded hole having a female screw penetrating each threaded hole-forming part in the radial direction is formed in each threaded hole-forming part, screw-insertion through holes that correspond to the threaded holes and penetrate the outer clamping member in the radial direction are formed at a plurality of places of the outer clamping member, a plurality of clamping screw members penetrate the screw-insertion through holes from the radially outer side and are screwed into the threaded holes, in the state where the inner and outer clamping members are fixed with the clamping screw members, a retaining stopper is provided at a part of the clamping screw member protruding from the threaded hole inward in the radial direction, the part being away from the threaded hole-forming part inward in the radial direction, and permanent magnets are provided at the inner and outer clamping members so as to repel each other.

2. The printing plate unit according to claim 1, wherein the inner clamping member includes a clamping part that clamps the printing plate and a guided part that extends inward from the clamping part in the radial direction of the cylindrical printing plate.

3. The printing plate unit according to claim 1, wherein the inner clamping member includes a clamping part that clamps the printing plate and a guided part that extends inward from the clamping part in the radial direction of the cylindrical printing plate, a plurality of perforated parts that penetrate the guided part in the circumferential direction of the cylindrical printing plate, and parts on an outer side of the perforated parts in the radial direction of the cylindrical printing plate constitutes the threaded hole-forming parts.

4. A device for attaching a printing plate, in which a plate section is provided on a part of a front surface of a sheet made of an elastic material, and engaging protrusions that protrude toward a back surface or a front surface and extend in a width direction are provided at longitudinal ends of the printing plate, to a plate driving shaft of a printer, the device comprising:

a printing plate coupling member that is detachable from the printing plate and engages with the engaging protrusions of the printing plate which is formed to be cylindrical to couple the longitudinal ends of the cylindrical printing plate to each other; and a cylindrical plate cylinder part that is fixedly provided at the plate driving shaft and has an outer periphery to which the cylindrical printing plate is attached from a front end of the plate driving shaft, wherein the plate cylinder part includes a printing plate coupling member storing groove that stores the printing plate coupling member to which the cylindrical printing plate is coupled from the front end of the plate driving shaft, an axial positioning stopper part that contacts a rear end of the printing plate coupling member, a printing plate coupling member guiding part that guides the printing plate coupling member to move in a predetermined range of the plate cylinder part in the radial direction, and a printing plate coupling member biasing device that biases the printing plate coupling member outward in the radial direction of the plate cylinder part, wherein the printing plate kept cylindrical by the printing plate coupling member is fitted onto the plate cylinder part from one end in a state in which the ends of the printing plate are fixed to the printing plate coupling member, wherein the printing plate coupling member storing groove is provided in a groove formation surface provided on the outer periphery of the plate cylinder part, wherein the printing plate coupling member includes an inner clamping member and an outer clamping member that clamp the longitudinal ends of the cylindrical printing plate at radially inner and outer sides, wherein the inner clamping member is a guided member guided to the printing plate coupling member guiding part when or after the printing plate coupling member is stored in the printing plate coupling member storing groove, and is biased outward in the radial direction of the plate cylinder part by the printing plate coupling member biasing device.

5. The printing plate attachment device according to claim 4, wherein the inner clamping member includes a clamping part that clamps the printing plate and a guided part that extend inward from the clamping part in the radial direction of the cylindrical printing plate, and the guided part is guided by the printing plate coupling member guiding part and biased by the printing plate coupling member biasing device.

6. The printing plate attachment device according to claim 5, wherein opposed guiding protrusions that extend in the axial direction of the plate cylinder part to constitute the printing plate coupling member guiding part are provided in side walls of the printing plate coupling member storing groove, which are opposed to each other in the circumferential direction of the plate cylinder part, an intermediate part of the guided part of the inner clamping member in the radial direction of the plate cylinder part is sandwiched between the guiding protrusions and slides in the axial direction and the radial direction of the plate cylinder part, and a part of the guided part of the inner clamping member, which protrudes from the guiding protrusions inward in the radial direction of the plate cylinder part is biased by the printing plate coupling member biasing device.

7. The printing plate attachment device according to claim 6, wherein the printing plate coupling member biasing device is arranged so as to be slidable along a wall of the biasing device storing recess in a predetermined range in the axial direction of the plate cylinder part, and includes an inner slider in which a wedge surface oriented to a front end of the plate driving shaft is formed on an outer side in the radial direction of the plate cylinder part, an outer slider arranged between the inner slider and the inner clamping member so as to be slidable along the wall of the biasing device storing recess in a predetermined range in the radial direction of the plate cylinder part, the outer slider in which a wedge surface oriented to the rear end of the plate driving shaft is formed on an inner side in the radial direction of the plate cylinder part so as to contact the wedge surface of the inner slider, an elastic member that biases the inner slider toward the front end of the plate driving shaft and a switching screw member that is screwed into the plate cylinder part and extends in the axial direction of the plate cylinder part, and the switching screw member moves to the rear end of the plate driving shaft, thereby moving the inner slider in the axial direction of the plate driving shaft against a biasing force of the elastic member and moves to the front end of the plate driving shaft, thereby being away from the inner slider.

8. The printing plate attachment device according to claim 7, wherein the inner slider is brought into close contact with a wall of the biasing device storing recess by a magnetic attraction force of permanent magnets, the outer slider is brought into close contact with a wall of the biasing device storing recess by the magnetic attraction force of permanent magnets, and the wedge surfaces of both the inner and outer sliders are brought into close contact with each other by the magnetic attraction force of permanent magnets.

9. The printing plate attachment device according to claim 6, wherein a guided part of the inner clamping member, which protrudes from the guiding protrusions inward in the radial direction of the plate cylinder part, is provided with movement restricting protrusions that contact the guiding protrusions, thereby preventing the inner clamping member from moving outward in the radial direction.

10. A printer comprising the printing plate attachment device according to claim 4.

11. A device for attaching a printing plate, in which a plate section is provided on a part of a front surface of a sheet made of an elastic material, and engaging protrusions that protrude toward a back surface or a front surface and extend in a width direction are provided at longitudinal ends of the printing plate, to a plate driving shaft of a printer, the device comprising:

a printing plate coupling member that is detachable from the printing plate and engages with the engaging protrusions of the printing plate which is formed to be cylindrical to couple the longitudinal ends of the cylindrical printing plate to each other; and a cylindrical plate cylinder part that is fixedly provided at the plate driving shaft and has an outer periphery to which the cylindrical printing plate is attached from the front end of the plate driving shaft, wherein the plate cylinder part includes a printing plate coupling member storing groove that stores the printing plate coupling member to which the cylindrical printing plate is coupled from the side of the front end of the plate driving shaft, a printing plate coupling member guiding part that guides the printing plate coupling member to move in a predetermined range of the plate cylinder part in the radial direction, and a printing plate coupling member biasing device that biases the printing plate coupling member outward in the radial direction of the plate cylinder part, and wherein the printing plate kept cylindrical by the printing plate coupling member is fitted onto the plate cylinder part from one end in a state in which the ends of the printing plate are fixed to the printing plate coupling member, wherein the printing plate coupling member includes an inner clamping member and an outer clamping member that clamp the longitudinal ends of the cylindrical printing plate at radially inner and outer sides, and wherein the inner clamping member is a guided member guided to the printing plate coupling member guiding part when or after the printing plate coupling member is stored in the printing plate coupling member storing groove, and is biased outward in the radial direction of the plate cylinder part by the printing plate coupling member biasing device.

12. The printing plate attachment device according to claim 11, wherein the plate cylinder part includes an axial positioning stopper part that contacts a rear end of the printing plate coupling member.

13. The printing plate attachment device according to claim 12, wherein the printing plate coupling member storing groove is provided in a groove formation surface provided on the outer periphery of the plate cylinder part, the axial positioning stopper part is provided at a bottom end of the plate driving shaft of the printing plate storing groove, the printing plate coupling member guiding part is provided in the printing plate coupling member storing groove, and at least a part of the printing plate coupling member biasing device is provided in a biasing device storing recess formed on the bottom of the printing cable coupling member storing groove.

14. The printing plate attachment device according to claim 11, wherein the inner clamping member includes a clamping part that clamps the printing plate and a guided part that extend inward from the clamping part in the radial direction of the cylindrical printing plate, and the guided part is guided by the printing plate coupling member guiding part and biased by the printing plate coupling member biasing device.

15. The printing plate attachment device according to claim 14, wherein opposed guiding protrusions that extend in the axial direction of the plate cylinder part to constitute the printing plate coupling member guiding part are provided in side walls of the printing plate coupling member storing groove, which are opposed to each other in the circumferential direction of the plate cylinder part, an intermediate part of the guided part of the inner clamping member in the radial direction of the plate cylinder part is sandwiched between the guiding protrusions and slides in the axial direction and the radial direction of the plate cylinder part, and a part of the guided part of the inner clamping member, which protrudes from the guiding protrusions inward in the radial direction of the plate cylinder part is biased by the printing plate coupling member biasing device.

16. The printing plate attachment device according to claim 15, wherein the printing plate coupling member biasing device is arranged so as to be slidable along a wall of the biasing device storing recess in a predetermined range in the axial direction of the plate cylinder part, and includes an inner slider in which a wedge surface oriented to a front end of the plate driving shaft is formed on an outer side in the radial direction of the plate cylinder part, an outer slider arranged between the inner slider and the inner clamping member so as to be slidable along the wall of the biasing device storing recess in a predetermined range in the radial direction of the plate cylinder part, the outer slider in which a wedge surface oriented to the rear end of the plate driving shaft is formed on an inner side in the radial direction of the plate cylinder part so as to contact the wedge surface of the inner slider, an elastic member that biases the inner slider toward the front end of the plate driving shaft and a switching screw member that is screwed into the plate cylinder part and extends in the axial direction of the plate cylinder part, and the switching screw member moves to the rear end of the plate driving shaft, thereby moving the inner slider in the axial direction of the plate driving shaft against a biasing force of the elastic member and moves to the front end of the plate driving shaft, thereby being away from the inner slider.

17. The printing plate attachment device according to claim 16, wherein the inner slider is brought into close contact with a wall of the biasing device storing recess by a magnetic attraction force of permanent magnets, the outer slider is brought into close contact with a wall of the biasing device storing recess by the magnetic attraction force of permanent magnets, and the wedge surfaces of both the inner and outer sliders are brought into close contact with each other by the magnetic attraction force of permanent magnets.

18. The printing plate attachment device according to claim 15, wherein a guided part of the inner clamping member, which protrudes from the guiding protrusions inward in the radial direction of the plate cylinder part, is provided with movement restricting protrusions that contact the guiding protrusions, thereby preventing the inner clamping member from moving outward in the radial direction.

19. A printer comprising the printing plate attachment device according to claim 11.

* * * * *